US012318046B2

(12) United States Patent
Leapman

(10) Patent No.: US 12,318,046 B2
(45) Date of Patent: Jun. 3, 2025

(54) LACTATION STATION

(71) Applicant: Nessel LLC, New Haven, CT (US)

(72) Inventor: Della Leapman, New Haven, CT (US)

(73) Assignee: Nessel LLC, New Haven, CT (US)

( * ) Notice: Subject to any disclaimer, the term of this patent is extended or adjusted under 35 U.S.C. 154(b) by 743 days.

(21) Appl. No.: 17/180,698

(22) Filed: Feb. 19, 2021

(65) Prior Publication Data

US 2021/0259475 A1 Aug. 26, 2021

Related U.S. Application Data

(60) Provisional application No. 62/980,211, filed on Feb. 22, 2020.

(51) Int. Cl.
*A47K 1/08* (2006.01)
*A47D 13/08* (2006.01)

(52) U.S. Cl.
CPC ..... *A47K 1/08* (2013.01); *A47D 13/08* (2013.01)

(58) Field of Classification Search
CPC .. E03C 1/12; A47K 1/08; A47D 13/08; A47B 21/0314; A47B 21/03
See application file for complete search history.

(56) References Cited

U.S. PATENT DOCUMENTS 1,084,211 A * 1/1914 Hunter ..... A47B 35/00 312/289
1,240,997 A * 9/1917 Moore ..... A47B 53/02 312/351
1,985,189 A * 12/1934 Moore ..... A47B 77/10 108/93
2,210,648 A * 8/1940 Battelle ..... A47B 77/10 312/294
2,293,496 A * 8/1942 Egger ..... A47B 1/00 312/289
2,716,307 A * 8/1955 Pollard ..... A47B 41/04 312/282
3,488,089 A * 1/1970 Brennan ..... A47C 7/70 297/154
4,072,157 A * 2/1978 Wines, Jr. ..... A61G 12/001 134/107
5,037,165 A * 8/1991 Rapp ..... A47B 88/994 248/340
5,465,438 A * 11/1995 Allman ..... A47K 1/02 4/640

(Continued)

*Primary Examiner* — Myles A Throop
(74) *Attorney, Agent, or Firm* — Greenberg Traurig, LLP

(57) ABSTRACT

A portable lactation station and method of use are disclosed. The portable lactation station may include a countertop, a base unit, and an adjustable counter component. The adjustable counter component may be configured to rest at least partially within the base unit when in an undeployed configuration. The adjustable counter component may be slidably connected to the base unit, and may be configured to open into a first deployed configuration and to slide into a second deployed configuration along the length of the base unit. The portable lactation station may include a sink and a faucet. The portable lactation station may also include a clean water source, an electric water pump, and a dirty water receptacle. The portable lactation unit may include integrated power and USB outlets on the surface of the primary body or adjustable counter surface component.

20 Claims, 24 Drawing Sheets

(56) References Cited

U.S. PATENT DOCUMENTS

| | | | | |
|---|---|---|---|---|
| 5,526,539 | A * | 6/1996 | Bower | A45D 19/04 312/317.3 |
| 6,206,495 | B1 * | 3/2001 | Peterson | A47B 21/0314 312/283 |
| 7,743,439 | B2 * | 6/2010 | Switzer | A47K 1/02 4/627 |
| 8,424,128 | B2 * | 4/2013 | Dvorak | A47B 77/06 4/630 |
| 9,681,747 | B1 * | 6/2017 | Pectol | A47B 13/083 |
| 9,706,833 | B2 * | 7/2017 | Newhouse | H01R 25/006 |
| 2003/0019031 | A1 * | 1/2003 | Mosis | E03C 1/18 4/625 |
| 2013/0200765 | A1 * | 8/2013 | Foss | B60P 3/36 312/240 |
| 2016/0073823 | A1 * | 3/2016 | Van Gelder | A47J 37/0786 126/25 R |
| 2017/0313229 | A1 * | 11/2017 | Isernio | B60N 2/78 |
| 2018/0259202 | A1 * | 9/2018 | Kim | F24F 3/14 |
| 2021/0353108 | A1 * | 11/2021 | Mazzotti | A47K 1/02 |

* cited by examiner

LACTATION STATION

CROSS-REFERENCE TO RELATED APPLICATION

This application claims priority under 35 U.S.C § 119(e) to U.S. Provisional Application No. 62/980,211, filed Feb. 22, 2020, which is incorporated by reference herein in its entirety.

TECHNICAL FIELD

The present disclosure relates generally to a furniture unit. More particularly, the present disclosure relates to a lactation station, and associated method of use, which can be configured to be portable, and may be configured to be permanent. The lactation station may further comprise a chair for use with the lactation station. The lactation station may be configured to fit within small spaces, such as closets, conference rooms, or cubicles. The lactation station may also include an adjustable or sliding counter component or pull out work surface. The lactation station may also include a sink, a faucet, a clean water supply, an electric water pump, a dirty water receptacle, and a refrigeration unit. The lactation station may also include integrated and preinstalled power and USB outlets on the top or side surfaces of the unit.

BACKGROUND

As employers become more aware of the needs of lactating employees, and as more lactating employees return to the work force, private and comfortable accommodations for mothers and lactating individuals become necessary. Due to space requirements in many workplaces, lactating individuals are often forced to pump in uncomfortable rooms or on uncomfortable furniture. There is often also no dedicated equipment or furniture to hold lactation supplies or safely store pumped breast milk. Further, many rooms offered to lactation do not include any dedicated facilities for cleaning lactation equipment and supplies. Even when employers have available small rooms, closets, or cubicles for pumping milk, they fall short of the needs of a lactating individual as they are lacking in comfort and refrigeration and sanitation capabilities.

Current accommodations provided in the workplace to allow lactating individuals to pump breast milk do not provided appropriate surfaces or means for storing or using equipment, nor means of storing pumped milk or cleaning breast pump supplies. Therefore, there is a need for effective and easy-to-implement lactation station meeting these needs while remaining compact for implementation in existing small rooms or areas. Furthermore, such a lactation station should be adapted for working employees and provide for a comfortable environment to continue working while pumping. The lactation stations and methods taught herein meet these previously unmet needs by providing for a compact and effective solution for lactating employees.

SUMMARY

The present disclosure relates generally to a furniture unit. More particularly, the present disclosure relates to a lactation station, and associated method of use, which may be configured to be portable or permanent, and may be configured to fit within small rooms, such as closets, conference rooms, break spaces, or cubicles. The lactation station may further comprise a chair for use with the lactation station. The lactation station can also include an adjustable or sliding work surface or counter component, a sink, a faucet, a clean water supply, an electric water pump, an in-line electric water heater, a dirty water receptacle, and a refrigeration unit. The aforementioned components and additional components may each be optionally included, or any of them may be optionally omitted from embodiments of the lactation station.

The modern workplace often includes small spaces, such as closets and cubicles, and the use of any spaces often needs to be optimized. As society becomes more aware of the need to accommodate a wide range of employees, including lactating mothers in the workplace, their needs must be met within the space available in the workplace. A furniture unit which may be configured to fit within small spaces to accommodate lactating individuals is hereafter disclosed.

A furniture unit may include a primary body unit and at least one adjustable counter component. A primary body unit may also be referred to as a base unit. While this disclosure discusses the use of a single adjustable counter component, it should be understood that two or more adjustable counter components may be used without deviating from the scope or intent of this disclosure. One aspect of the adjustable counter component is to provide flexible and ergonomic positioning of the breast pump (which is tethered to the body) and required work items. The adjustable counter component surface may be moved to optimize comfortable positioning of the breast pump and to accommodate optimal body position while pumping as well as optimal positioning of work materials, increasing overall productivity and support. The adjustable counter component may also allow the lactation unit to fit in a variety of small spaces. The sliding/adjustable surface may also facilitate easier setup and cleanup of lactation equipment. The lactation station may have integrated and installed power and USB outlets on the primary body unit or adjustable counter component. The USB outlets may be any type of USB outlet, including but not limited to, USB-A, USB-B, USB-C, mini-USB, and/or micro-USB.

A primary body unit may include a top surface, such as a countertop, and a front face. The front face may be the front of the countertop, though it may also be located lower down on the primary body unit, such as at or in proximity to one or more optional doors. Though three doors are shown in some specific exemplary embodiments herein, it should be understood that no doors may be present, only one or two doors may be present, or four or more doors may also be present. Drawers or shelves may also optionally be present.

Though not shown in specific exemplary embodiments, the primary body unit of the lactation unit may extend to the ground. The lactation unit may extend to the ground and be mounted on casters. The primary body unit may or may not include installed power and USB outlets.

An adjustable counter component may be substantially planar, or may have at least one substantially planar top surface, and may be extendably or rotatably connected to the primary body unit. The top surface of the adjustable counter component may be substantially parallel to the top of the counter top or top surface of the primary body unit when in an undeployed configuration, and it may be substantially parallel to the top of the counter top or top surface of the primary body unit when in a deployed configuration. The adjustable counter component may be substantially recessed within the countertop or the primary body unit when it is in an undeployed configuration, such as fitting substantially, entirely, or at least partly within a slot or recess in the counter top or primary body unit. It may alternatively sit partially, substantially, or fully, within a recess in the countertop.

The adjustable counter component may rotate out into a deployed configuration, or it may slide out into a deployed configuration. When in a deployed configuration, the adjustable counter component may extend substantially away from the front face of the lactation station. In some embodiments, the adjustable counter component may be slidably connected to the base unit. In some embodiments, a slidably connected component is not directly attached to a base unit and may rest upon a portion of a base unit. In some embodiments, a slidably connected component may be retained or guided by portions of the component or portions of a base unit to which the component is slidably connected. In further embodiments, a slidably connected component may have at least one portion that is slidably connected while another portion may be connected by additional means.

The adjustable counter component may be configured to move into a second deployed configuration. In one embodiment, the lactation station may include a countertop and a sink and faucet. The adjustable counter component may be located substantially in front of the countertop when in the first deployed configuration, and substantially in front of the sink when in the second deployed configuration. The adjustable counter component may be deployed or located in a plurality of different configurations or positions between the first deployed configuration and the second deployed configuration, i.e. a third deployed configuration. In some embodiments, one example of a third deployed configuration may be a middle position between the first and second deployed configurations.

In an embodiment where the adjustable counter component is slidably connected to the primary body unit or countertop, it may slide forward into the first deployed configuration, then may slide sideways into a second configuration or a third configuration. It can be appreciated that the adjustable counter component may be positioned at any position in-between the first deployed configuration and the second deployed configuration. In an embodiment where the adjustable counter component is rotatably connected to the primary body unit or counter top, such as rotating around a pivot point at or near to the centerline, width-wise, of the counter top, the adjustable counter component may rotate out into the first deployed configuration, then optionally be further rotated out into a second or third deployed configuration. It should be understood that combinations of connection and movement may also be used, such as rotating into the a first deployed configuration and sliding into a the second or third one, or vice versa.

The top surface of the adjustable counter component may be substantially parallel to the countertop when in the undeployed configuration, the first deployed configuration, the second deployed configuration, the third deployed configuration, or all of the above, remaining substantially horizontal throughout use.

The lactation station may also include a source of clean water. In one embodiment, the lactation station includes a connection to a water bottle, such as those available for personal or commercial water storage, or water bubblers. The water bottle may be within an at least partially open space, volume, compartment, or cavity within the primary body unit, or may optionally be located below and next to the primary body unit. It should be understood that external water supplies may also optionally be used, such as where a water line is present in the area of intended use for the lactation station. The lactation station may use compartmentalized clean water storage or may tie into the building's plumbing for a clean water source. The lactation station may also optionally include a water pump, such as an electric water pump, to draw water from the clean water supply to the faucet and sink. The lactation station may also include a means of draining dirty or otherwise used water or other liquids. In one embodiment, the lactation station may include a dirty water tank which may be connected to the drain of the sink. It should be understood that, for environments where water drainage is available external to the lactation station, the lactation station may optionally include a drainage means leading out of the primary body unit. The lactation station may use compartmentalized wastewater storage or may tie into the building's primary plumbing waste line. In embodiments which include a clean water tank or a dirty water tank, one or both may be optionally removable from the lactation station. Water heaters such as in-line electric water heaters may optionally be used or mounted within the main body to heat water for the sink.

The lactation station may optionally include a refrigeration unit. In some embodiments, the refrigeration unit is a stand-alone refrigerator, such as what is often referred to as a "mini fridge", though other refrigerators, including custom ones, may also optionally be used. The refrigerator may be electrically hardwired or tied to the power supply of the main lactation unit via a power strip mounted within the lactation station or built into it. The refrigerator may be removable and may plug directly into an external power source. The power source itself may draw electricity from another power source within the lactation station or from an external source. In other embodiments, the refrigeration unit may be removably or non-removably built into the lactation station. The refrigeration unit may be internal to the lactation station and optionally have a door of the lactation station blocking it, or the refrigeration unit's own door may also optionally be used so as to face a user of the station.

Though not shown in specific embodiments, the lactation station may include additional features or components to aid in storage, use, cleaning, or drying of lactation supplies. The countertop or primary body unit may include recesses or cup holder-like features or components to aid in retaining milk bottles. The adjustable counter component may also optionally include such features. The countertop or primary body unit may also optionally include a drying rack or features to aid in retaining lactation supplies after they have been washed and prior to being put away. The inside of the primary body or cabinet may include additional features for storage of lactation or cleaning supplies. The lactation station may also optionally include a sterilization system, such as a UV light box, for lactation supplies.

In one method of use, a user may use the countertop to set up their lactation supplies. In one method of use, a user may use the pull-out work surface to set up their lactation supplies. The adjustable counter component may be opened into a first deployed position and some lactation supplies may be placed upon, for easier access and reach. A user may optionally sit in a chair, such as an ergonomic lactation chair, which may optionally have surfaces or features for supporting equipment, laptops, bottles of or for breast milk, or other items. In some embodiments, a chair is specifically adapted for use with the lactation station and is used in conjunction with the lactation station. In some embodiments, a chair may include recesses or holders for milk bottles. The adjustable counter component may be aligned to be within comfortable access of a user in such a chair. When a user is done, the adjustable counter component may be slid or rotated or otherwise moved into a second deployed position, in closer proximity to the sink. The user may then clean their supplies and put them away. The adjustable counter component may then be returned to an undeployed position.

The method may include the use of a unit which may include one or more of the features, steps, or components described herein. Any number of steps or elements may be used in conjunction with the method described, and various means for connections, gripping, storage, and protection may be incorporated.

It is to be understood that the above-mentioned steps and features and the steps and features yet to be explained hereinafter can be used not only in the respectively mentioned combinations but also in other combinations or alone without departing from the intent or context of the teachings herein.

BRIEF DESCRIPTION OF THE DRAWINGS

The invention is now disclosed in detail with reference to exemplary embodiments shown in the accompanying drawings, where.

DETAILED DESCRIPTION

Figure 1:
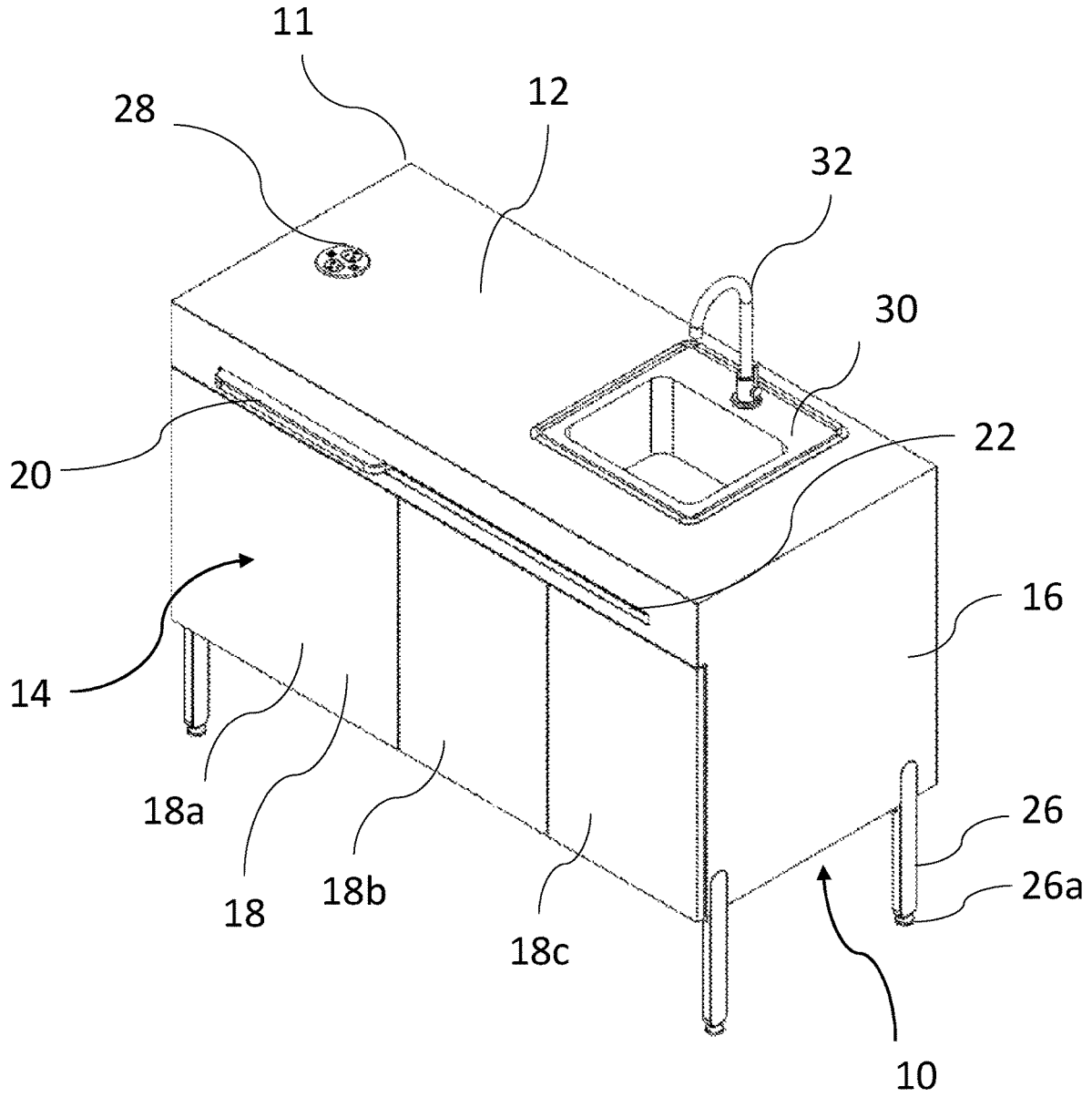
FIG. 1 shows a front top right isometric view of an exemplary embodiment of the lactation station of the present disclosure in a closed configuration.
Figure 2:
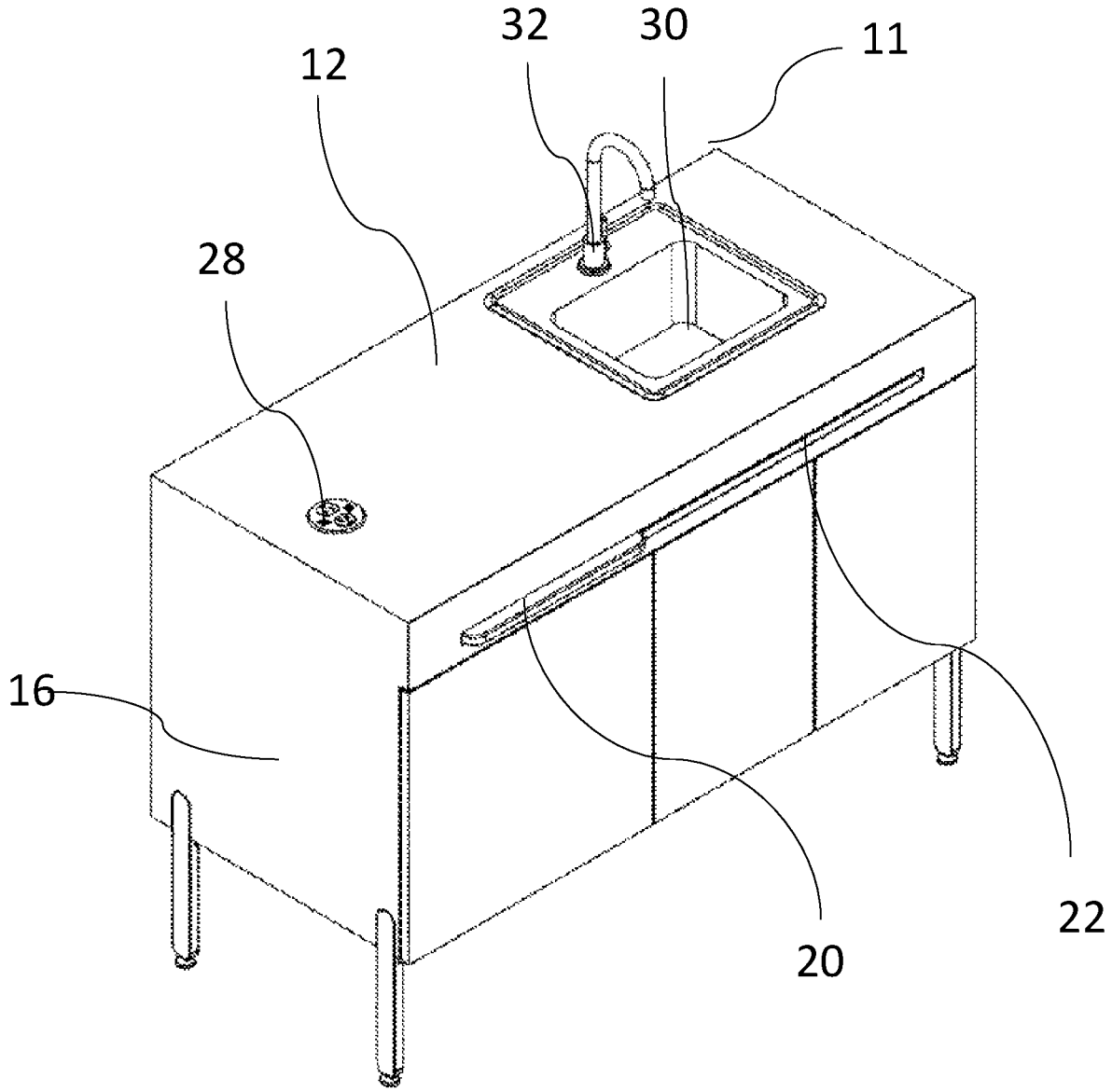
FIG. 2 shows a front top left isometric view of the exemplary embodiment of the lactation station of FIG. 1 in a closed configuration.
Figure 3:
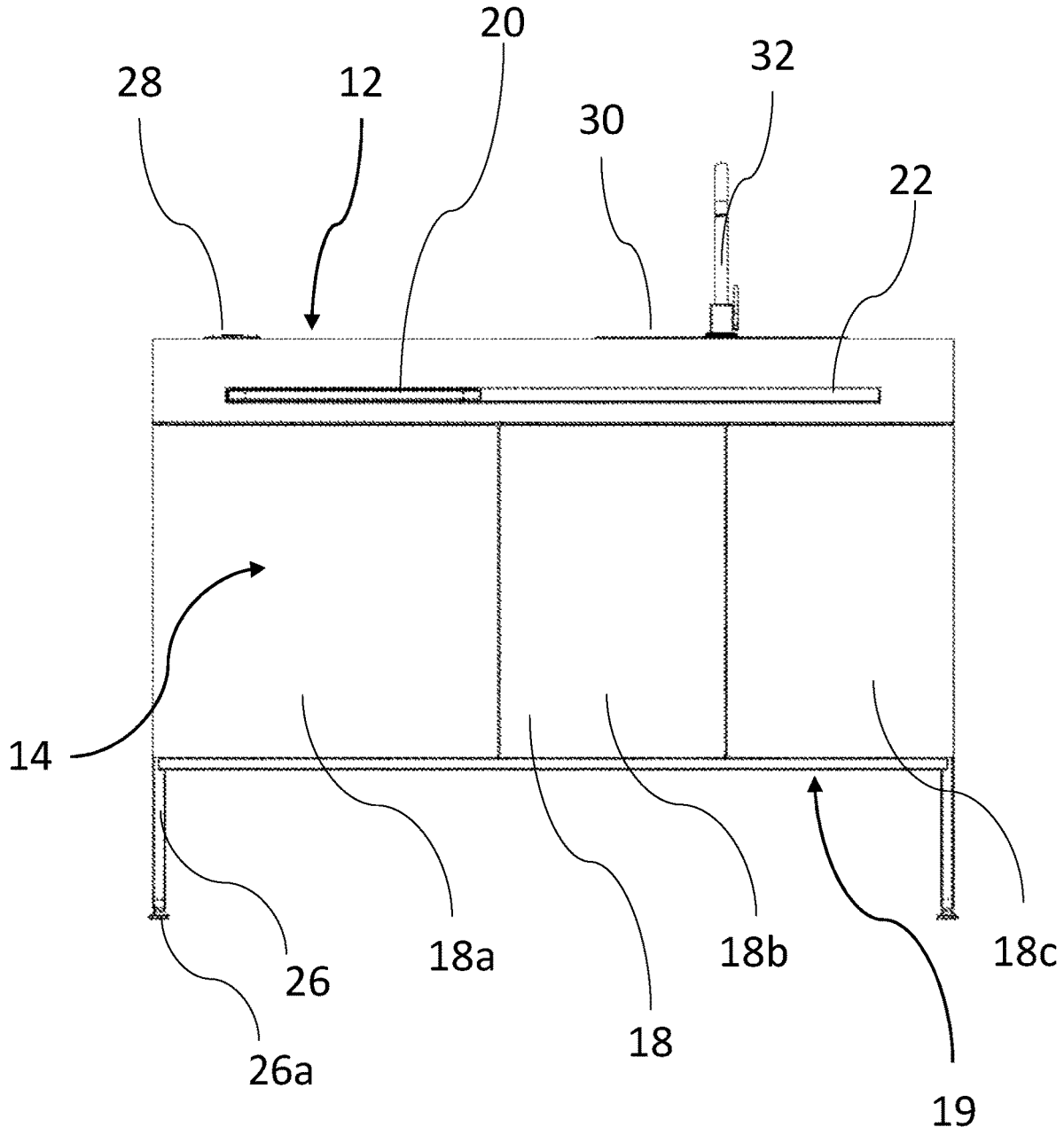
FIG. 3 shows a front view of the exemplary embodiment of the lactation station of FIG. 1 in a closed configuration.
Figure 4:
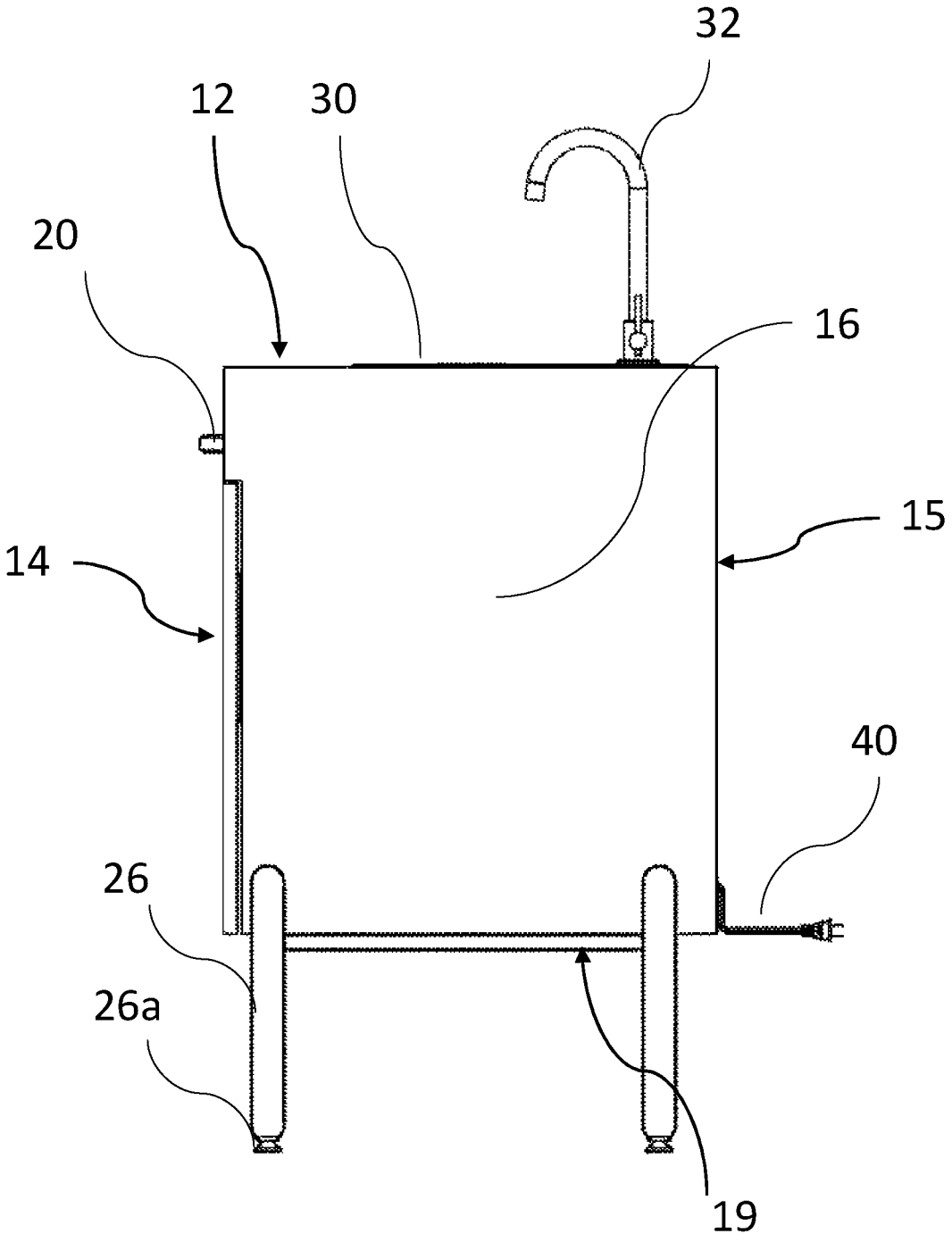
FIG. 4 shows a right side view of the exemplary embodiment of the lactation station FIG. 1 in a closed configuration.
Figure 5:
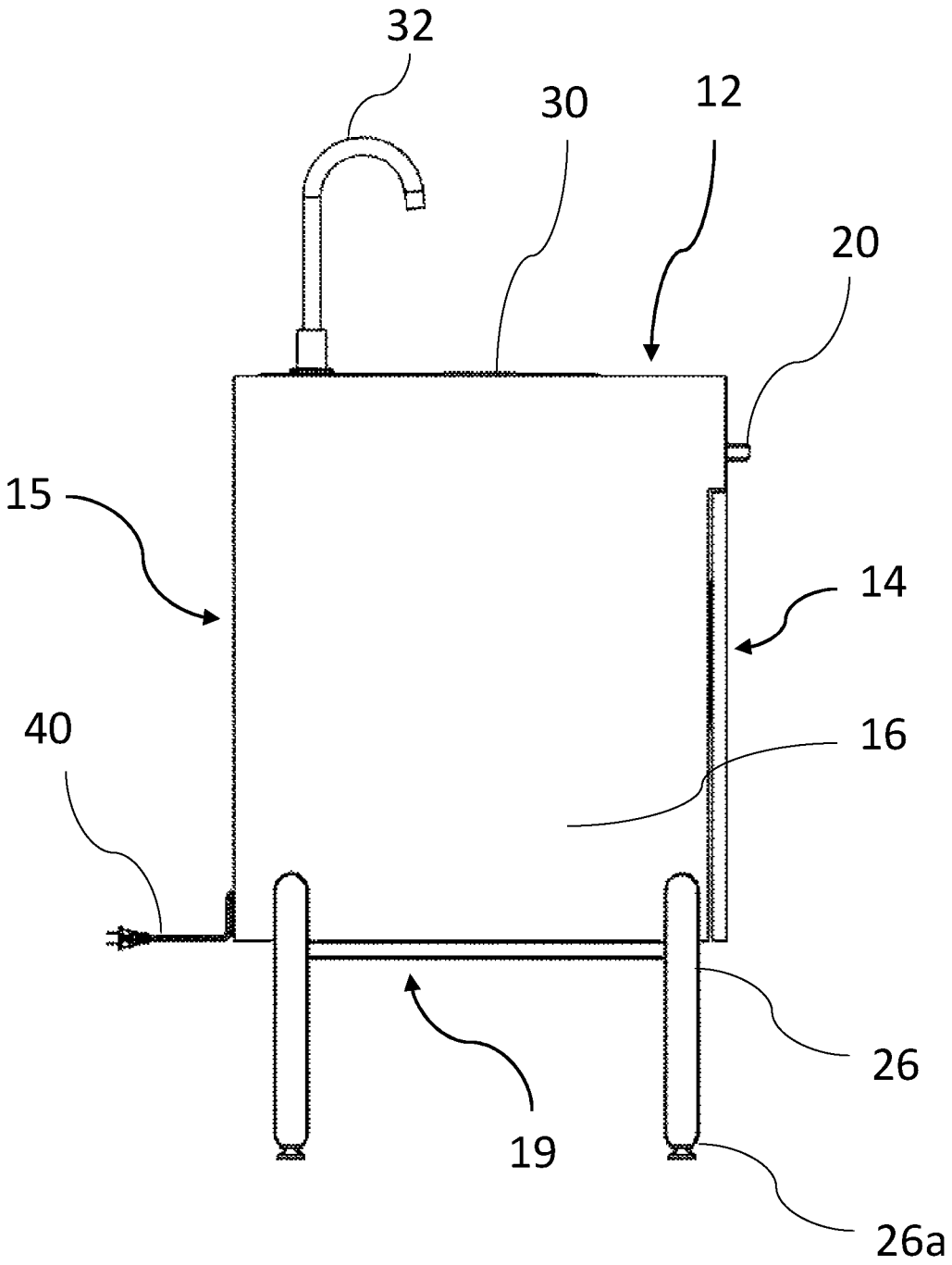
FIG. 5 shows a left side view of the exemplary embodiment of the lactation station of FIG. 1 in a closed configuration.
Figure 6:
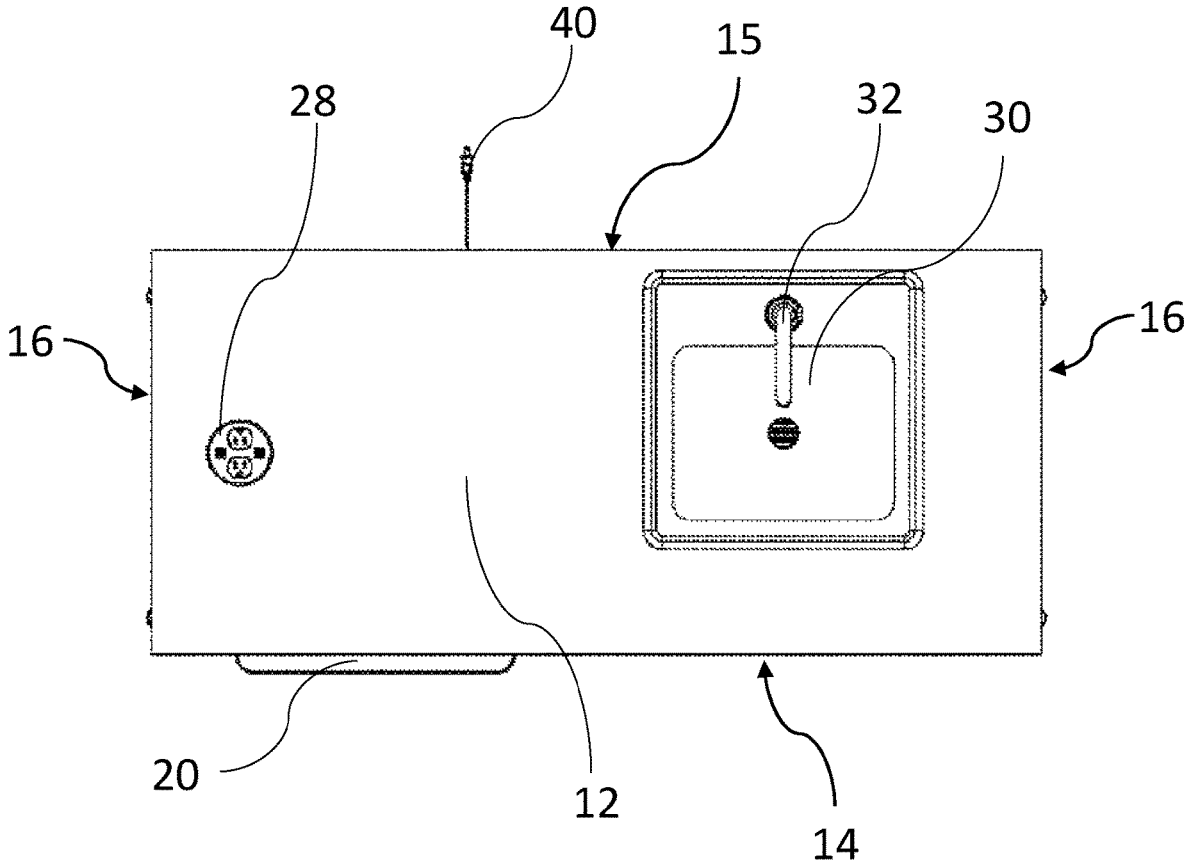
FIG. 6 shows a top view of the exemplary embodiment of the lactation station of FIG. 1 in a closed configuration.
Figure 7:
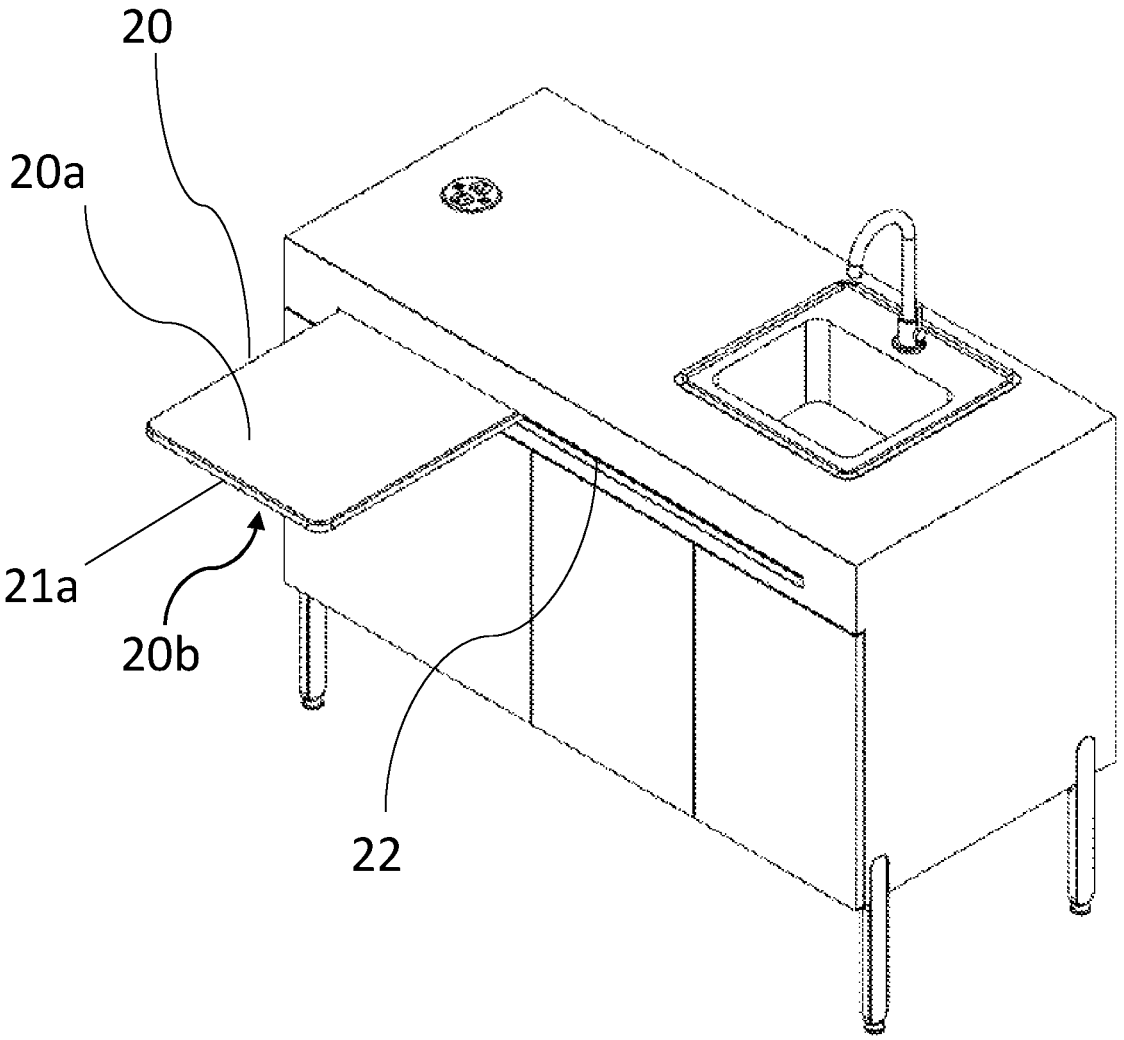
FIG. 7 shows a front top right isometric view of an exemplary embodiment of the lactation station of the present disclosure in a first deployed configuration.
Figure 8:
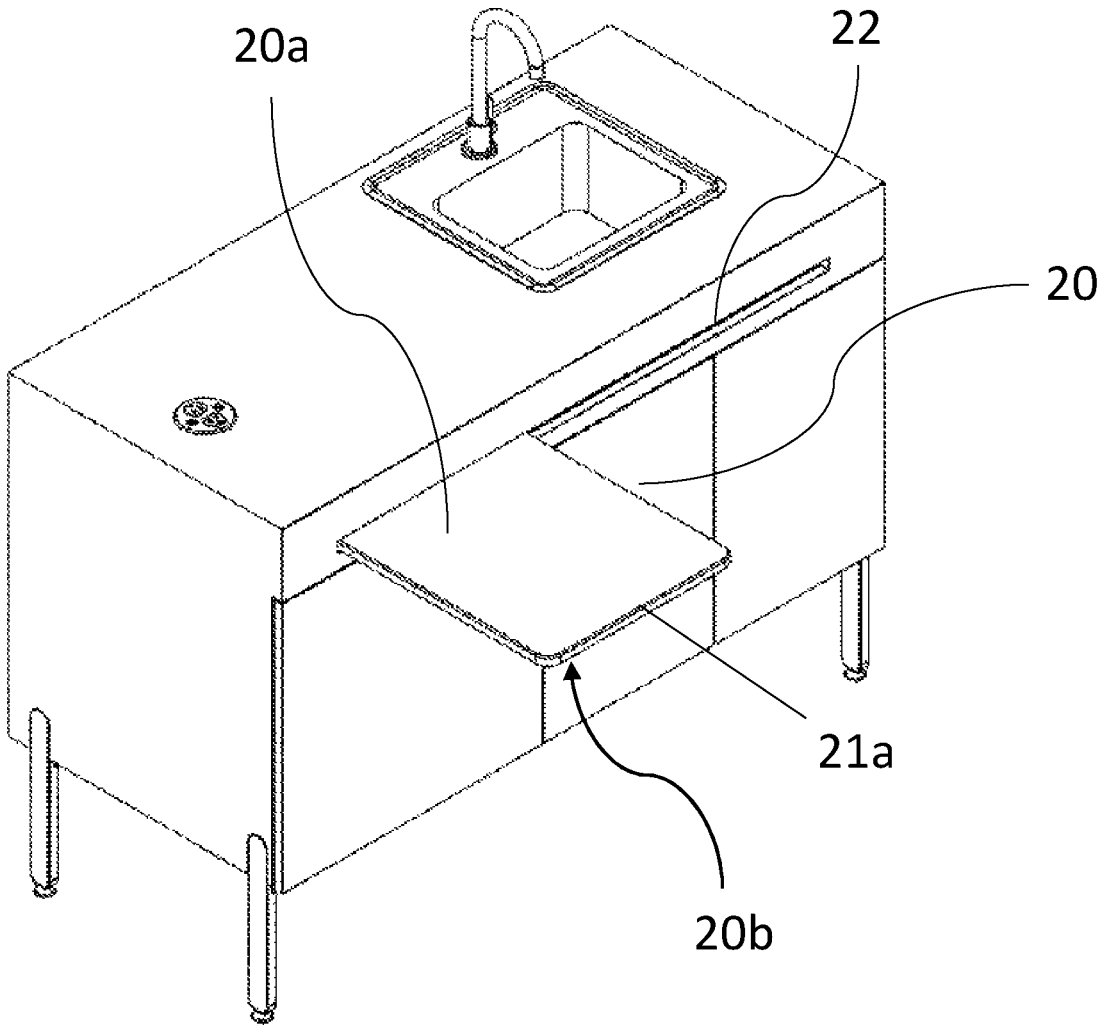
FIG. 8 shows a front top left isometric view of the exemplary embodiment of the lactation station of FIG. 7 in a first deployed configuration.
Figure 9:
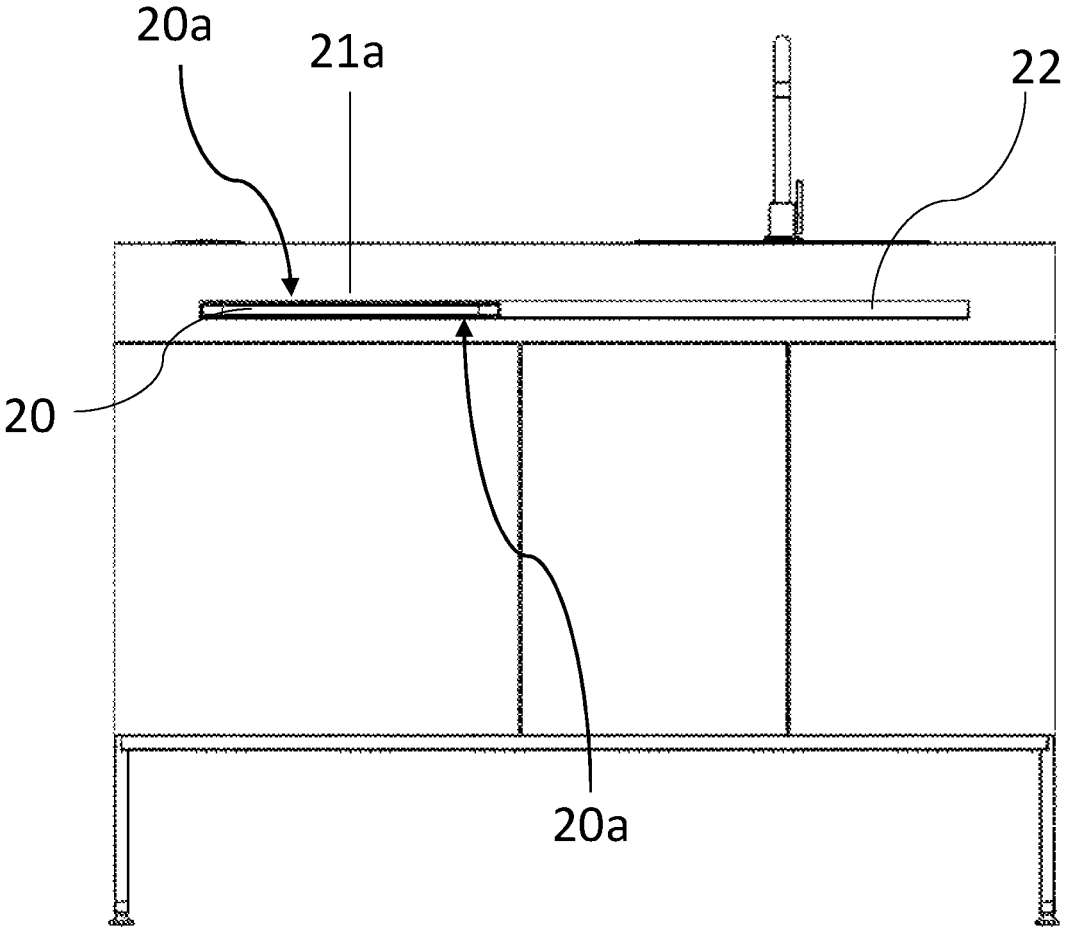
FIG. 9 shows a front view of the exemplary embodiment of the lactation station of FIG. 7 in a first deployed configuration.
Figure 10:
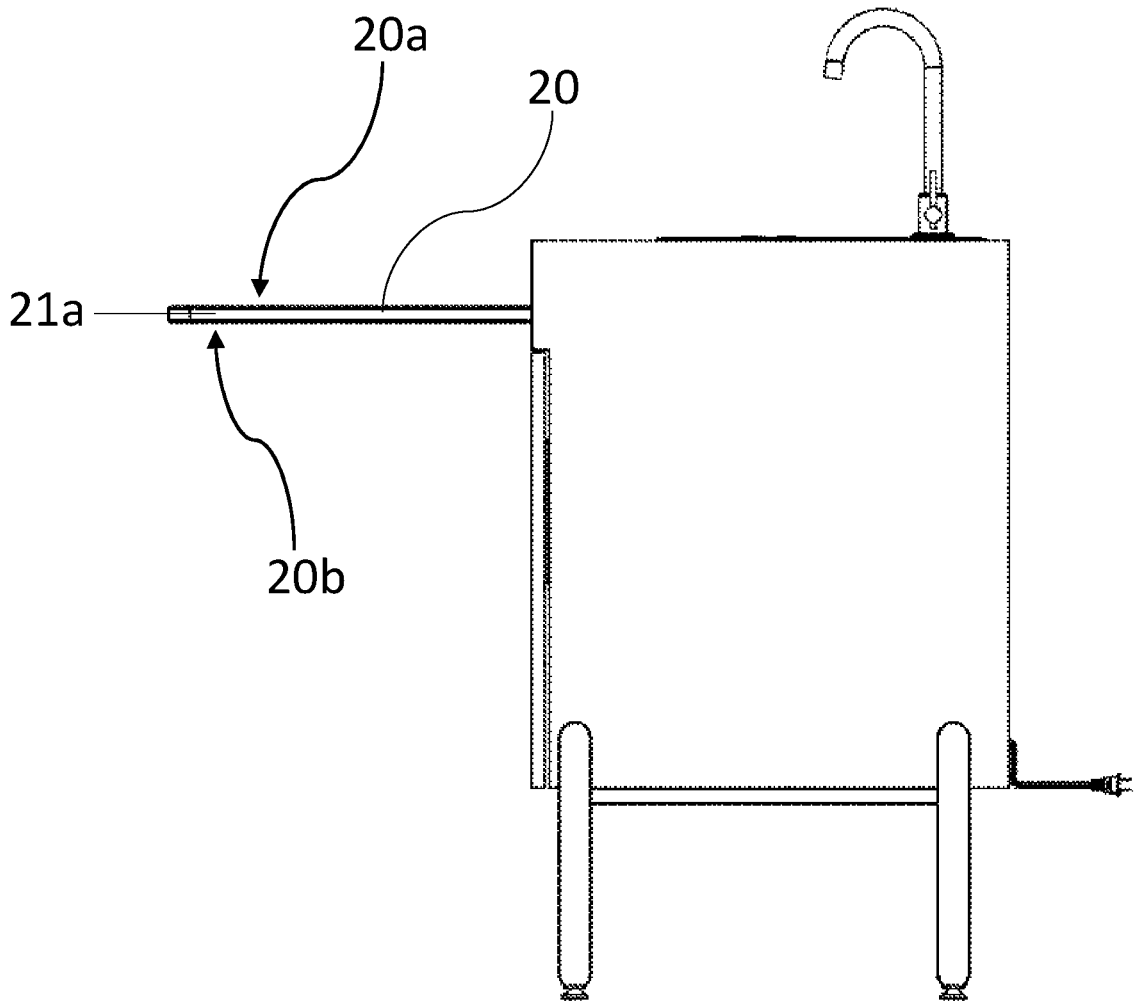
FIG. 10 shows a right side view of the exemplary embodiment of the lactation station of FIG. 7 in a first deployed configuration.
Figure 11:
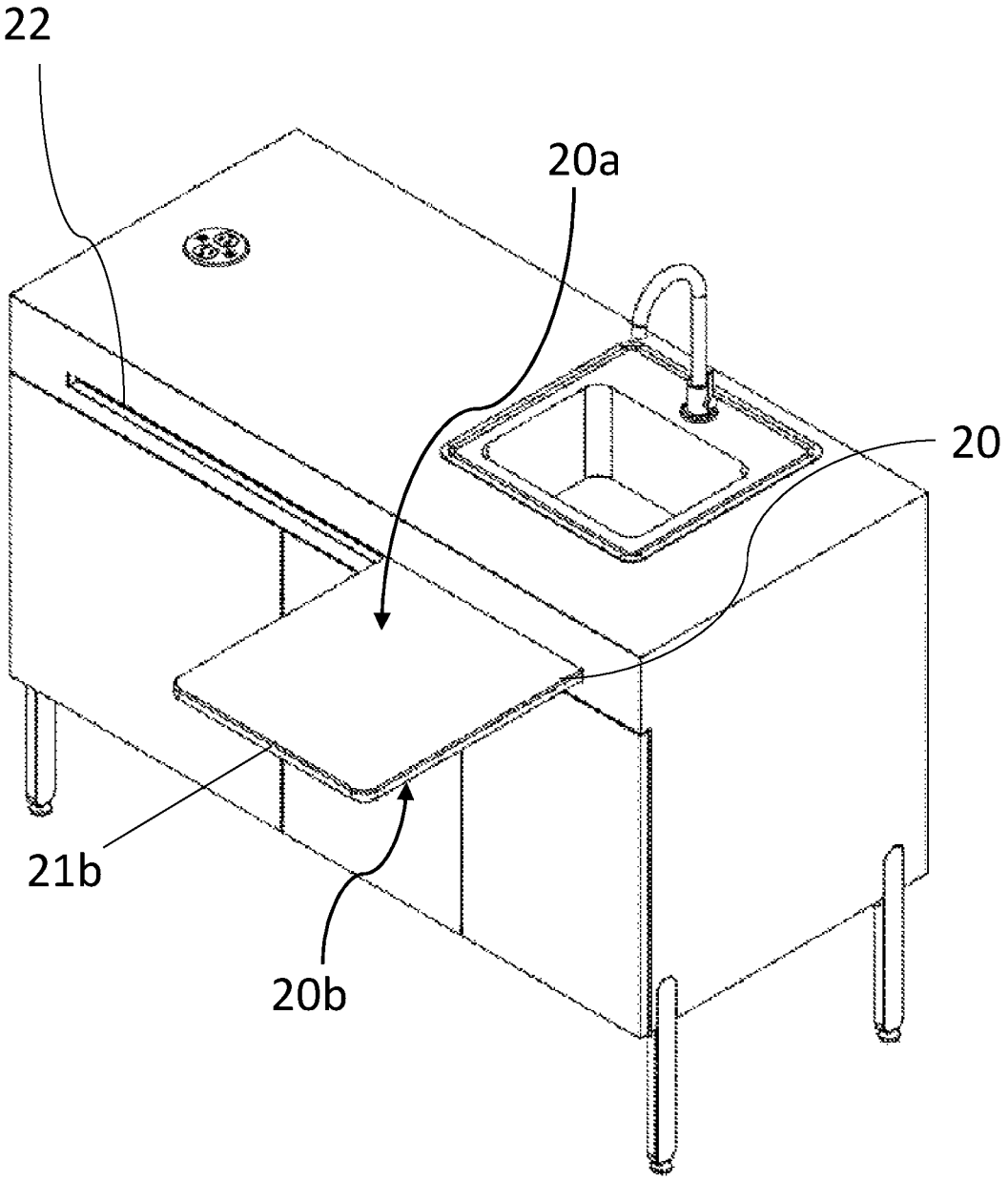
FIG. 11 shows a front top right isometric view of an exemplary embodiment of the lactation station of the present disclosure in a second deployed configuration.
Figure 12:
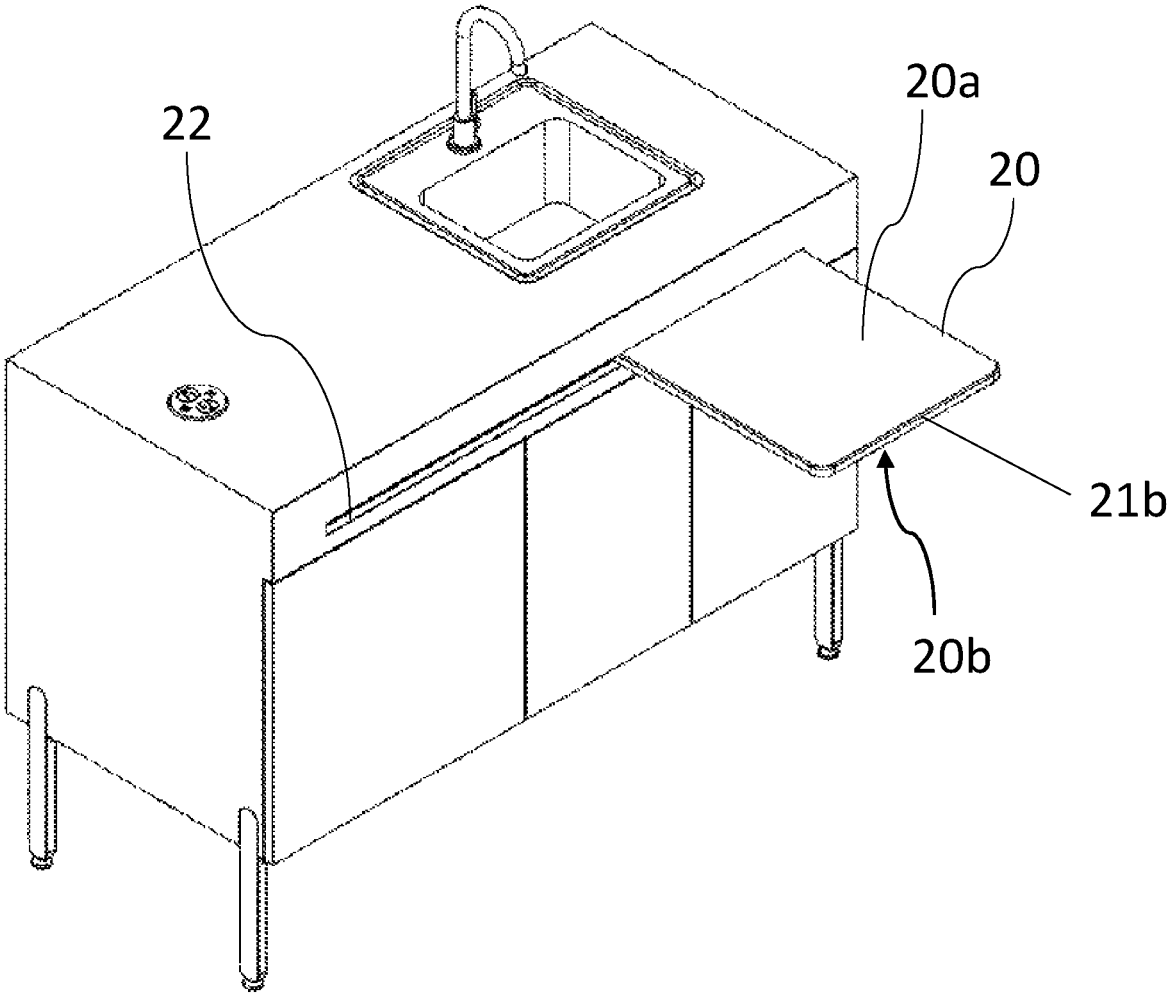
FIG. 12 shows a front top left isometric view of the exemplary embodiment of the lactation station of FIG. 11 in a second deployed configuration.
Figure 13:
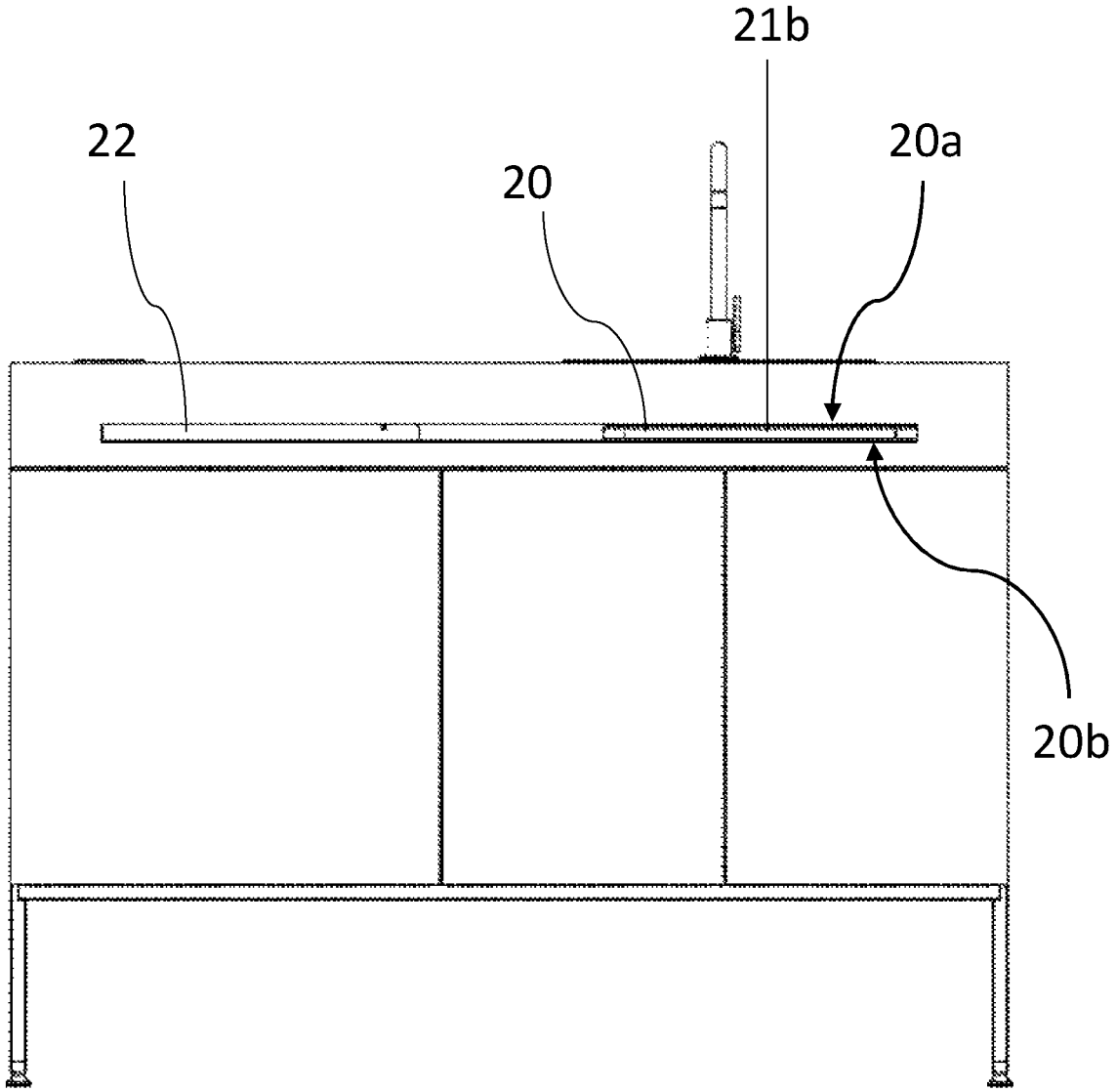
FIG. 13 shows a front view of the exemplary embodiment of the lactation station of FIG. 11 in a second deployed configuration.
Figure 14:
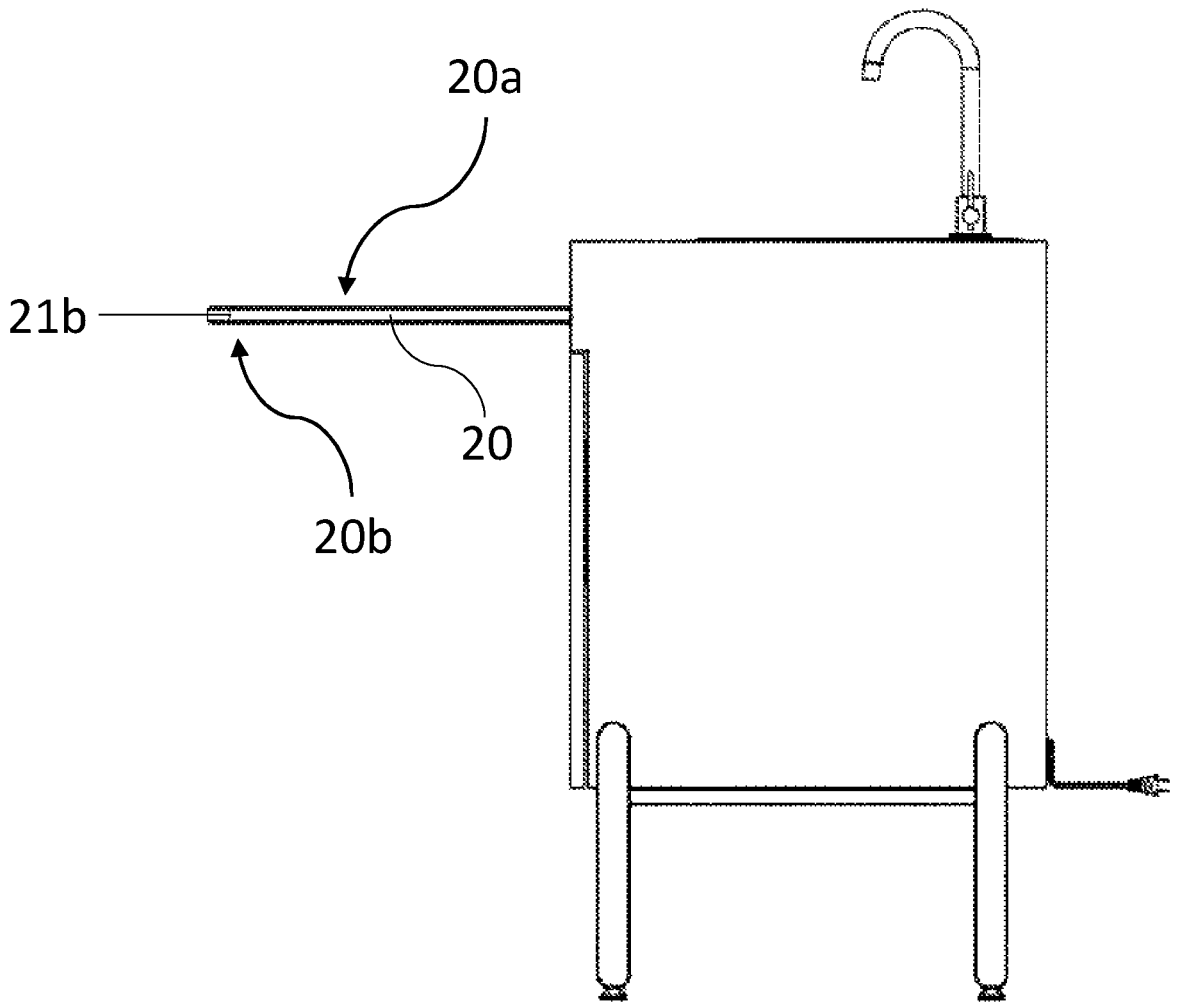
FIG. 14 shows a right side view of the exemplary embodiment of the lactation station of FIG. 11 in a second deployed configuration.

Exemplary embodiments of the disclosure are illustrated in the Figures and are explained in the following description in more detail, wherein identical reference numbers refer to identical, or similar, or functionally identical or similar components.

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials, steps, and configurations are set forth in order to provide a thorough understanding of the illustrative embodiments. However, it will be apparent to one skilled in the art that the present invention may be practiced without the specific details. In other instances, well-known features or those previously described are omitted or simplified in order not to obscure the illustrative embodiments.

Various operations may be described as multiple discrete operations, in turn, in a manner that is most helpful in understanding the present invention, however the order of description should not be construed as to imply that these operations are necessarily order dependent. In particular, these operations need not be performed in the order of presentation. In some instances, structures and devices may be shown in block diagram or flow chart form in order to facilitate describing the disclosed subject matter.

An exemplary embodiment of a lactation station 10 is shown in FIGS. 1-6. The primary body unit 11 may generally have the overall form of a furniture unit with a top slightly or substantially parallel to the surface on which the unit rests and front, back, and side faces extending downwardly from the top surface to provide any number of front, rear, side, bottom or other faces. The primary body unit 11 may comprise a first top surface 12 and at least one front face 14 extending downwardly therefrom. The primary body unit 11 may comprise one or more side faces 16 extending downwardly from the top surface and the side faces may be slightly or substantially perpendicular to the front face 14. The primary body unit 11 may further comprise one or more rear faces 15 which are slightly or substantially parallel to the front faces and extend downwardly from the top surface. The lactation station may be sized and configured to fit in confined spaces, such as cubicles, closets, and other smaller locations within office buildings. In one exemplary embodiment, the lactation station may be 47¾" wide, 21¾" deep, and 34" tall; however, it should be understood that any or all of these dimensions may be increased or decreased without deviating from the scope or intent of this disclosure.

The lactation station may include one or more adjustable counter components 20, as depicted in FIG. 1, and housed within one or more recesses 22. In an exemplary embodiment, a sliding counter may extend from the unit 11, such as, for example, a pull-out sliding counter extendably housed within the one or more recesses 22. The counter may be partially or entirely recessed within a portion of the lactation station when in a closed configuration, as shown in FIG. 1. In the embodiment shown, the adjustable counter is not fully recessed within the lactation station when closed, but instead remains at least partially exposed, such as for approximately 1", enabling a user of the lactation station to easily grasp the adjustable counter and slide it out from its closed position. One or more tactile features may be disposed on this graspable section of the adjustable counter to enable a person to slide the counter out. It should be understood that the adjustable counter may be recessed less or more than 1" when closed, or may be entirely recessed. In some embodiments, a recess may define an opening to recessed compartment where an adjustable counter is partially housed or enclosed. In some embodiments, an adjustable counter component is recessed within the front face of the base unit. In some embodiments, a front face can comprise any front-facing surface of a lactation station or base unit, including portions of a countertop, a front face of a top portion, and/or a separate panel below the top surface.

In embodiments where the adjustable counter is entirely recessed within the lactation station when in a closed configuration, the adjustable counter may include features to aid a user is grasping the counter to pull it out, such as undercuts, notches, knobs, tabs, or other features. Alternatively, the top or side of the lactation station may include one or more recesses to provide access to at least a portion of the adjustable counter to aid in opening the adjustable counter. It should also be understood that embodiments of the lactation station where it may be preferable to have all top surfaces of the lactation station remain in position, such as for storage of lactation supplies, laptops, or other personal effects, may include an adjustable counter which may be recessed within at least a portion of the lactation station when in a closed configuration. However, other embodiments, such as ones intended for aiding a user in bringing items from the top of the lactation station closer to the user, may include an adjustable counter which slides out from or along the top of the lactation station, or may alternatively rotate or fold into an open configuration.

The lactation station may include at least one faucet and may also include at least one sink disposed within the top surface. The sink 30 may have one or more drains connected to a waste container held within the primary body unit 11, or connected to a wastewater line. The sink may comprise a faucet 32. The faucet 32 may be connected to a water source contained within the primary body unit 11 having a manual or electric pump to provide water pressure. The water may be room temperature, or the water may be heated by one or more in-line electric water heaters connected between the water source and the faucet. The faucet 32 may be connected to an external water supply line. The faucet 32 may have one water supply line or two water supply lines. The faucet 32 may be connected to a cold-water supply line, a hot water supply line, or both hot and cold water supply lines. A faucet and sink may be used by a user to clean lactation supplies prior to use, after use, or prior to storage. In some embodiments, a lactation station may omit a sink, faucet or any plumbing components. A lactation station may also optionally include one or more power supplies enabling a user to plug in electrical equipment, such as breast pumps, laptops, or cellular phones, or to plug in devices or cords which use connections such as USB ports. In an embodiment shown, the top surface 12 of the lactation station includes a USB power station 28 which further includes two USB power supply ports and two standard USA electrical plugs, though it should be understood that other configurations and numbers of power supplies and/or connectors may also be used without deviating from the scope or intent of this disclosure. In an alternative exemplary embodiment, other charge ports and/or connection ports used with any electronic device (e.g., smartphone, tablet, PC, WiFi, routers, server ports, network switches, etc.) may also be disposed on the top surface 12 or other suitable surface of the unit 11.

The lactation station may include one or more legs 26 to provide support and stability to the lactation station. In the embodiment shown, the lactation station includes four legs, providing clearance and potential storage room beneath the lactation station. The legs may be threaded into the lactation station, though they may also be retained in position through other means, such as screws, bolts, press-fits, welding, dove-tail joints, dowels, adhesives, or other means known in the art. The legs may further include feet **26*a*** which may aid in retaining the lactation station in position, may minimize damage to flooring, such as carpets, or may aid in sliding the lactation station from one location or position to another, such as through the use of plastics or low friction materials such as Teflon. In alternate embodiments, the legs may include one or more wheels or casters, or may be entirely absent and one or more wheels may be mounted directly to the underside or sides of the lactation station, such as to enable easy relocation of the lactation station. Where wheels are used, one or more wheels may be optionally lockable. It should be understood that, in some alternate embodiments, the lactation station may include neither legs nor wheels, but the bottom of the lactation station may rest directly on flooring, a separate base unit, or other support structures.

The lactation station may include a substantially planar surface, such as a flat top or top surface 12. The top may include notches, recesses, or proud storage features, such as to aid in retaining lactation or cleaning supplies. In the embodiment shown, the top of the lactation station is substantially flat, except for proud elements of the electrical ports, sink, and faucet. The top of the lactation station may be made of any material which is sufficiently rigid to retain supplies on top of the station, such as wood, plastic, metal, composite materials, or other materials known in the art, and may optionally include a surface finish, such as a veneer.

The lactation station may include a slot, recess 22, or other feature to allow room for the adjustable counter to move from a first open configuration to a second open configuration, such as from an open position on one side of the sink to a second position in front of the sink. Though the embodiment shown stores the adjustable counter to the left of the sink, slides it out into an open position still to the left of the sink, and allows for sliding to substantially in front of the sink, it should be understood that other orientations and configurations may also be used without deviating from the scope or intent of this disclosure.

The lactation station may include one or more doors on its one or more front faces 14 which may provide access to one or more storage areas within the lactation station, or to one or more functional elements of the lactation station, or both. The one or more front faces 14 may comprise one or more doors 18 which open to access one or more compartments defined by the front, rear, side, and bottom faces. The front face defining such compartments may be a permanent or immovable face, a door, a sliding face or door, a curtain, or any other face or covering. In the embodiment shown, the front face 14 of the lactation station includes a first door 18*a*, which, when opened, provides access to a refrigeration unit within the lactation station, and a second 18*b* and third 18*c* door which, when opened, provide access to a substantially open volume below the sink such as a plumbing cabinet, including clean water and a water pump on one side and dirty water storage on the other. The doors may optionally include handles or other functionally similar features, or may be pressed in to release them from a closed position, enabling them to rebound at least partially into an open position, such as through the use of springs. In the embodiment shown, the doors are retained in position through the use of one or more magnetic push latches.

In the embodiment shown, the lactation station may include one or more electrical power lines, such as an electrical plug, which may be plugged into a power source which is external to the lactation station. Power may then be routed to an optional electrical water pump and/or to a power supply for the refrigeration unit, such as a power strip, and/or to the optional USB ports.

An exemplary embodiment of the lactation station is depicted in a first open configuration in FIGS. 7-10. As shown, the adjustable counter has been slid out from its closed configuration forward away from the main body of the lactation station. It should be understood that the adjustable counter may also be rotated out into an open configuration, or may be opened through other means, such as those taught herein. The adjustable counter may optionally lock into a first open position or otherwise resist unintentional movement through the use of balls plungers, light press-fit features, or other means known in the art, or may only rest in position due to its own weight and friction.

An embodiment of the lactation station is shown in a second open configuration, with the adjustable counter moved to substantially in front of the sink portion of the lactation station, in FIGS. 11-14. In one method of use, a user may sit in a chair, such as an ergonomic lactation chair, in proximity to the adjustable counter when the adjustable counter is in a closed configuration. The adjustable counter may be slid into a first open configuration, at which point lactation supplies may be placed upon the adjustable counter. When a user is done using the lactation supplies, the adjustable counter may be slid into the second open position, as shown, moving all of the supplies to closer proximity to the sink and making it easier for a user to clean the supplies.

The adjustable counter may move from a first open position 21*a* to a second open position 21*b* along ball bearings, along wheels, along rails, along rails and wheels, or it may slide directly. In embodiments where the adjustable counter slides directly, friction reducing materials, surfaces, or liners may optionally be used. In one embodiment, the slot through which the adjustable counter at least partially slides may include a laminated surface, such as a ¼' thick filler sheet, to reduce friction and enable easier and less damaging sliding of the adjustable counter.

Figure 21:
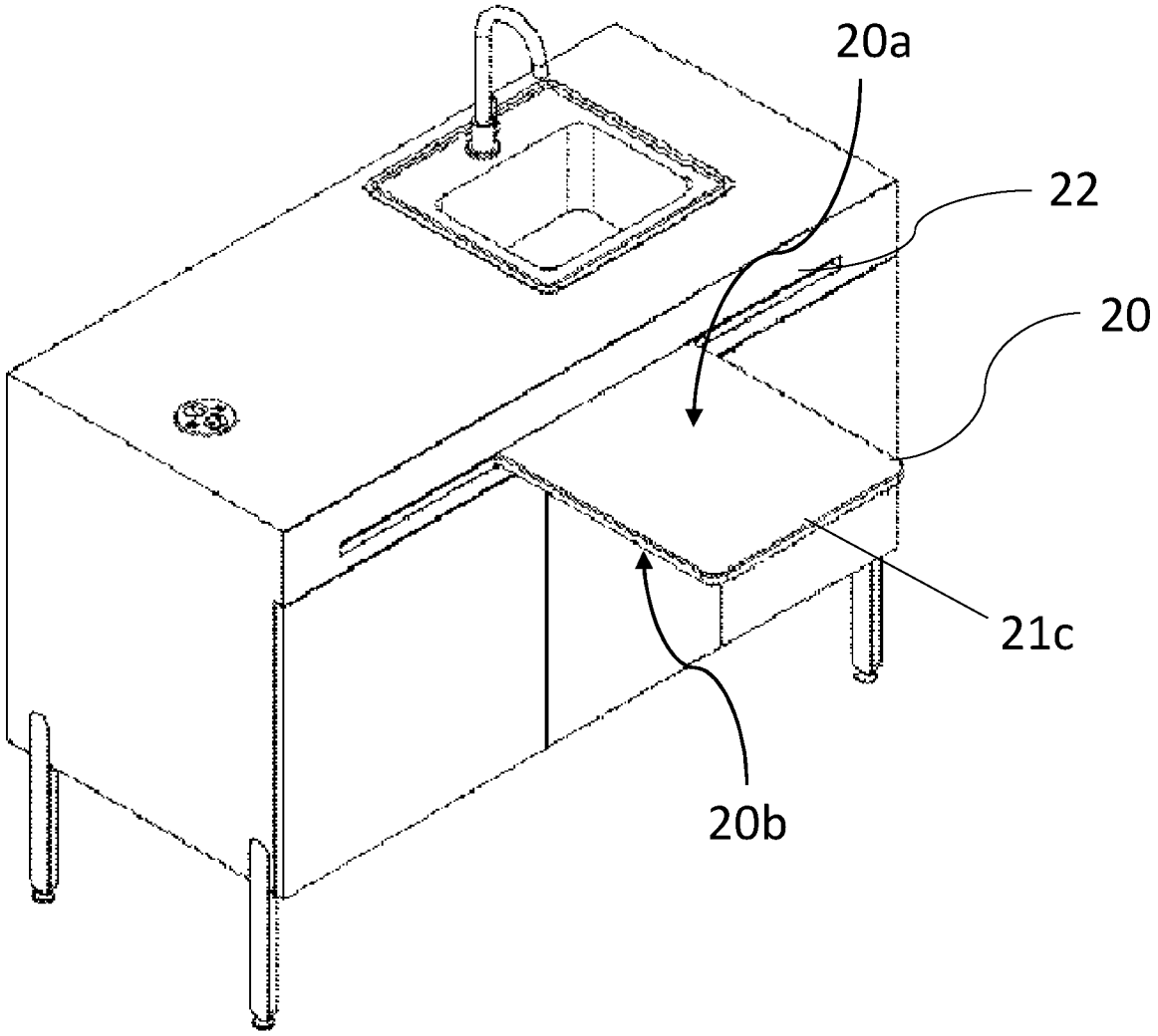
FIG. 21 shows a front top left isometric view of an exemplary embodiment of the lactation station in a third deployed configuration.

The adjustable counter having a top surface 20*a* and bottom surface 20*b* may move from a first open or deployed position to any third open or deployed position 21*c* between the first open or deployed position 21*a* and the second open or deployed position 21*b*. An exemplary third open position is depicted in FIG. 21 wherein the adjustable counter component may be located approximately in the middle of the first open position and the second open position or, as described differently, in the middle of the recess 22. It can be appreciated that the adjustable counter may be set or placed at any position between the first open or deployed position and the second open or deployed position.

Figure 15:
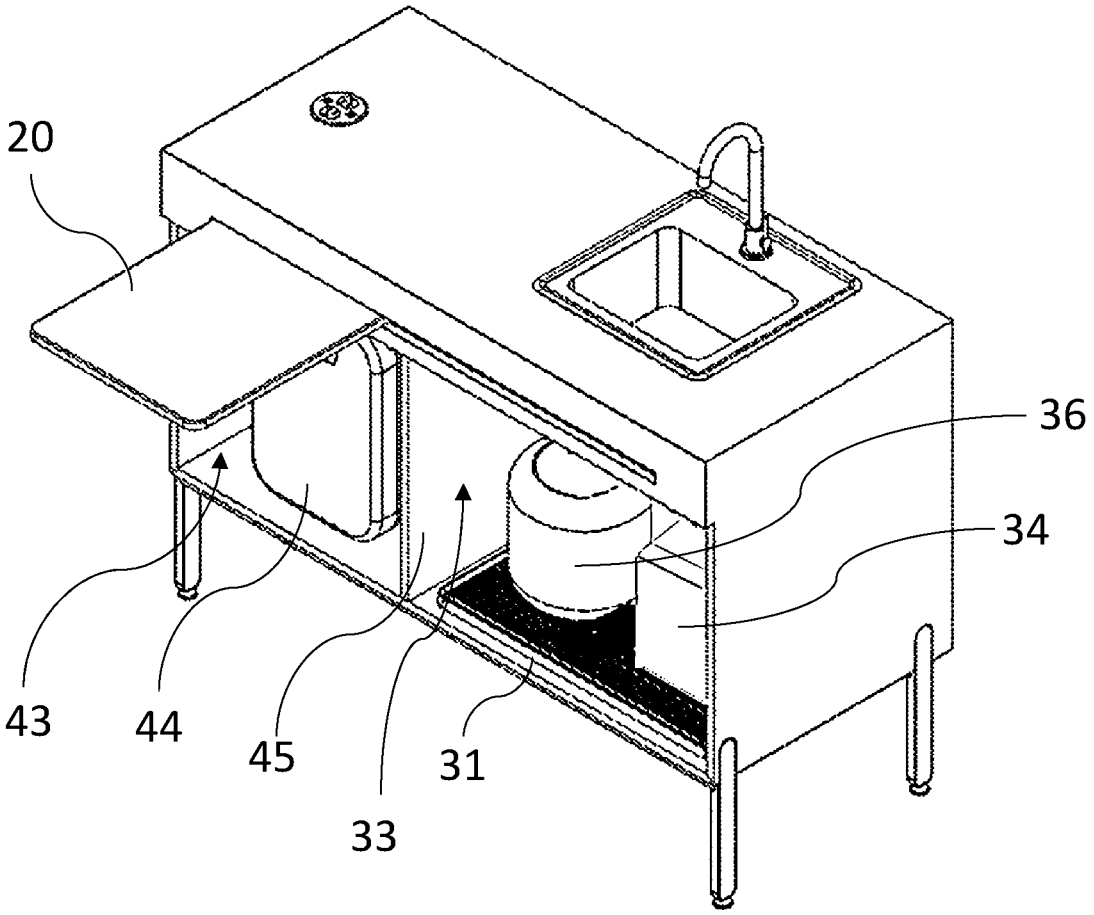
FIG. 15 shows a front top right isometric view of an exemplary embodiment of the lactation station of the present disclosure in a first deployed configuration with doors removed.
Figure 16:
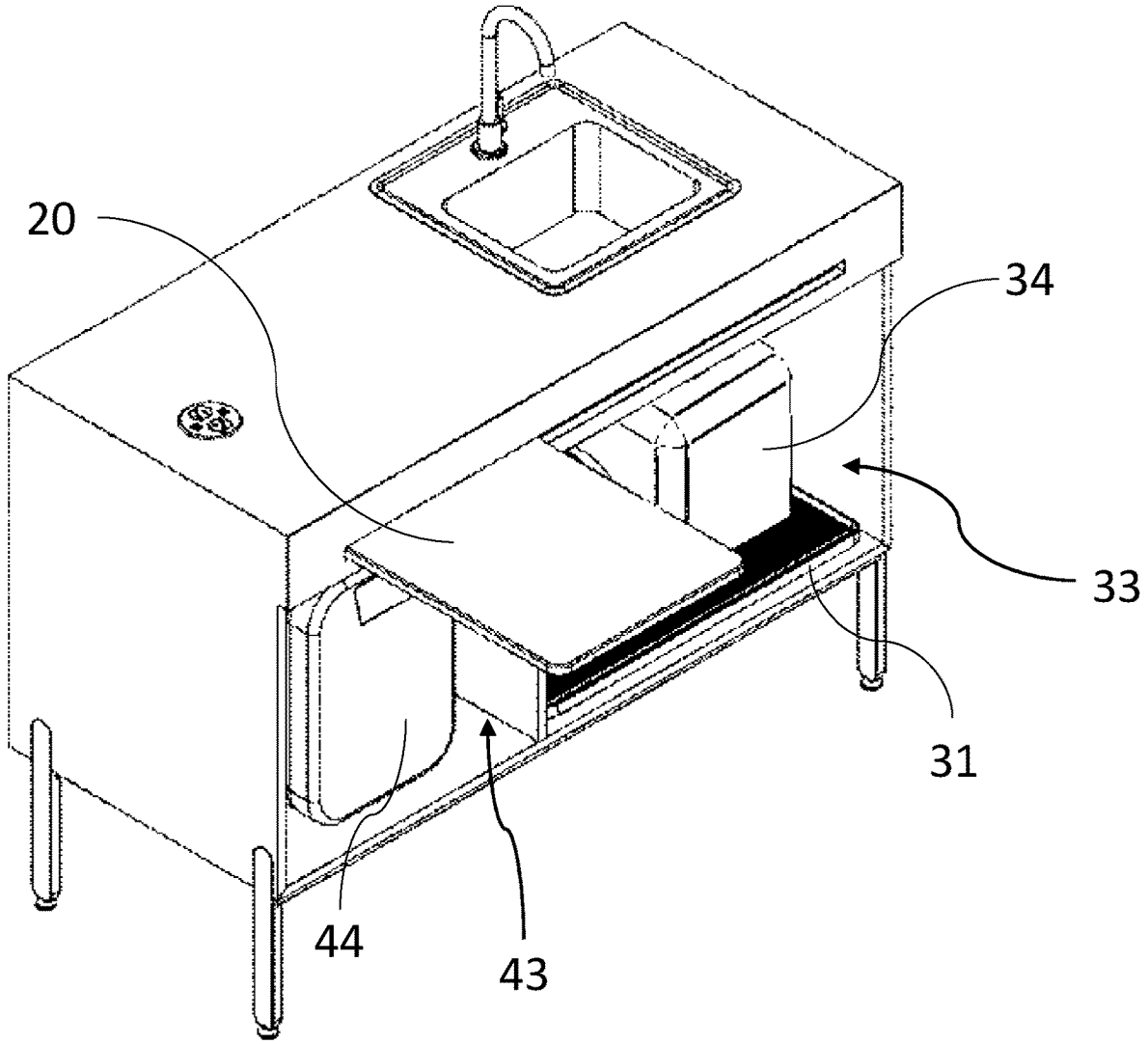
FIG. 16 shows a front top left isometric view of the exemplary embodiment of the lactation station of FIG. 15 in a first deployed configuration with doors removed.
Figure 17:
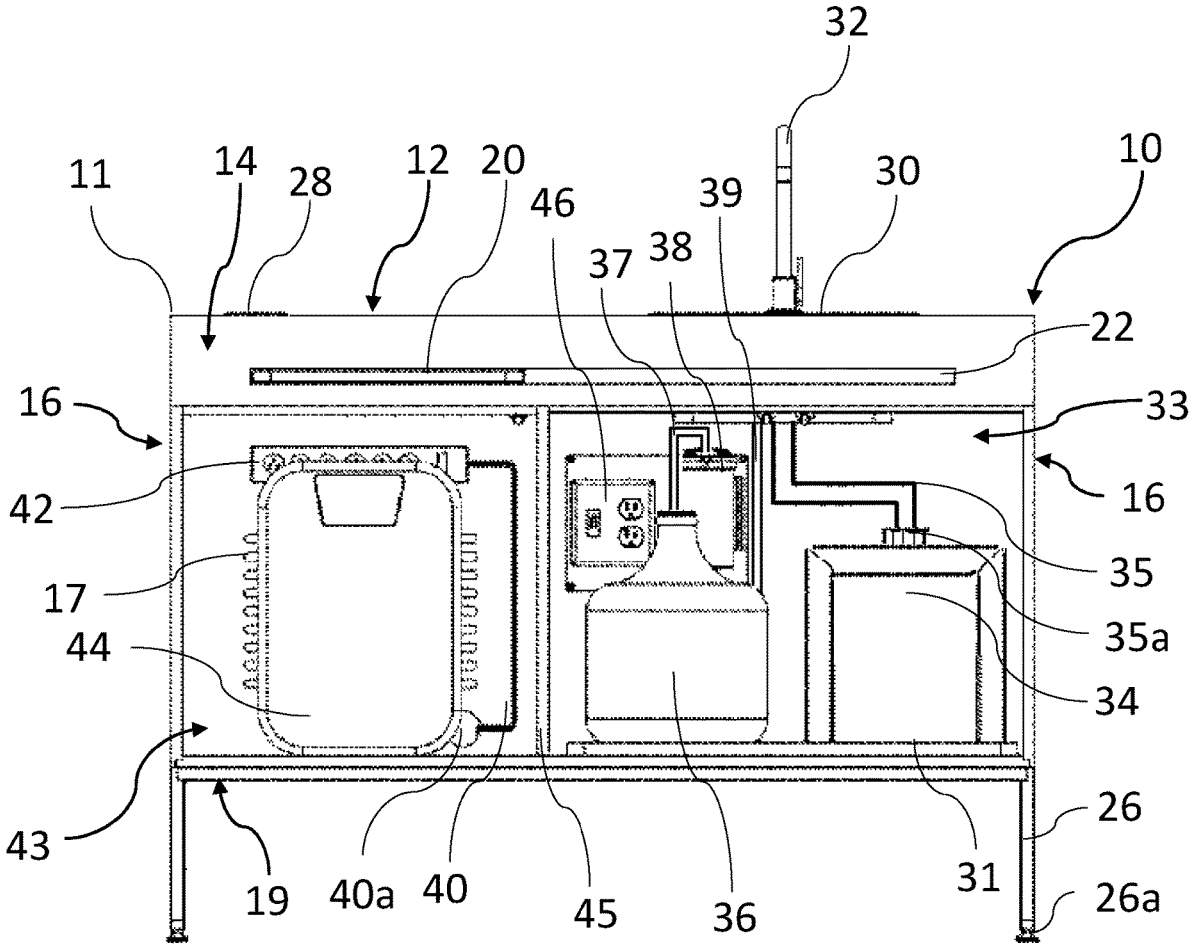
FIG. 17 shows a front view of the exemplary embodiment of the lactation station of FIG. 15 in a first deployed configuration with doors removed.

FIGS. 15-17 show an exemplary embodiment of the lactation station with the doors removed for clarity. The lactation station may further include one or more cabinet racks, such as a metal door-mounted cabinet rack. Cleaning or other supplies may be stored with such a rack. The lactation station may also include a source of clean water. In the depicted embodiment, a first compartment 33 may be separated from a second compartment 43 by a divider 45 that may fully or partially separate the compartments. The first compartment 33 may comprise a freshwater tank 36 and a wastewater tank 34. In some embodiments, the freshwater tank 36 and wastewater tank 34 may be seated on top of one or more extendable shelves or trays that allow for each to be to be more easily removed or replaced. In some embodiments, the freshwater tank 36 and wastewater tank 34 may be seated on a mat or tray 31 configured and dimensioned to accommodate the tank.

A wastewater tank 34 may be connected to a wastewater or drain line 35 that is connected to the sink drain. In some embodiments, the wastewater or drain line 35 may be fully or partly made from a flexible tubing material. In some embodiments, the wastewater or drain line may include a flexible or rigid trap or p-trap portion that is generally U-shaped, curved, or otherwise configured in dimension to prevent odor from escaping the drain. In some embodiments, the wastewater or drain line 35 may be connected to the wastewater container 34 with a releasable connector 35*a*. In some embodiments, the wastewater or drain line may be a flexible or fully rigid piping material connected to an external wastewater line.

In some embodiments, the freshwater tank 36 may be connected to the faucet 32 by one or more tubes and/or in-line pumps or water heaters. In some embodiments, an in-line electric pump 38 may comprise an inlet tube 37 extending into the freshwater tank 36 such that the inlet tube is substantially below the water level of the freshwater tank. In some embodiments, an in-line electric pump 38 may further comprise an outlet tube 39 that connects the electric pump to the faucet. In further embodiments, either the inlet tube 37 or outlet tube 39 may have one or more in-line electric water heater units connected therein and configured to provide heated water to the faucet. In some embodiments where the faucet 32 is supplied by a single water line, the water heater unit may be connected within said single water line. In some embodiments where the faucet 32 is supplied by two water lines, the water heater unit may be connected within an auxiliary water line branched off from the water pump outlet tube 39. It can be appreciated that any appropriate means to provide cold, room-temperature, or heated water from the freshwater tank 36 to the faucet 32 are contemplated. In some embodiments, the freshwater tank 36 may be omitted if the faucet 32 is connected to an external water source. In some embodiments, the wastewater tank 34 may be omitted if the wastewater or drain line 35 is connected to or comprises a portion of an external wastewater line. In some cases, both the freshwater tank 36 and the wastewater tank 34 may be omitted if the faucet and wastewater or drain line are each connected to external water sources or drain lines, respectively.

A clean water line may be connected to the lactation station for users who locate the lactation station in proximity to a clean building water supply, though the embodiment shown includes an optional freshwater tank, such as commercially available water bottles. The lactation station may also optionally include a water pump, which may be manual or powered. In the embodiment shown, the lactation station includes an electric water pump which receives power from the power being provided to the lactation station. The water pump may pump water from the clean water tank to the faucet when the faucet is turned on, enabling a user to wash any lactation supplies before and/or after use and before storage. Dirty water from the sink may be drained from the sink into a receptacle, such as a wastewater tank in the embodiment shown. A wastewater line may be connected to the lactation station for users who locate the lactation station in proximity to a building plumbing waste line.

In some embodiments, a first compartment 33 may comprise an electrical outlet 46 with an optional switch or breaker. In some embodiments, an electric pump 38 may be plugged into the electrical outlet. In some embodiments, an in-line water heater may be plugged into the electrical outlet. In some embodiments, the electrical outlet 46 may be plugged into an external electricity source. In some embodiments, the electrical outlet 46 may be plugged into a power strip or electricity source 42 contained within a second compartment 43. In some embodiments, the power strip or electricity source 42 may have a power or electrical cord 40 that is routed through the back 15 of the primary body unit 11 to be connected to an external power source. In some embodiments, a refrigerator unit may be located within a compartment and may be connected to the power strip or electricity source 42. The compartment may be adapted to allow for heat generated by the refrigerator to escape. In some embodiments, the back face 15 may comprise one or more vents 17. In some embodiments, the vents may be incorporated into one or more of the sides, rear, front, bottom, or top faces. In some embodiments, the refrigerator or refrigeration unit may be generally useful for storing pumped breast milk, or for storing any other items which might be beneficial to a user to store in a controlled temperature environment. The refrigeration unit may be optionally built or hardwired into the lactation unit or it may be removable and plugged into an external power source. In an embodiment shown, the refrigeration cabinet of the lactation station includes an optional and optionally removable small refrigerator connected to a power strip mounted within the main body.

Figure 18:
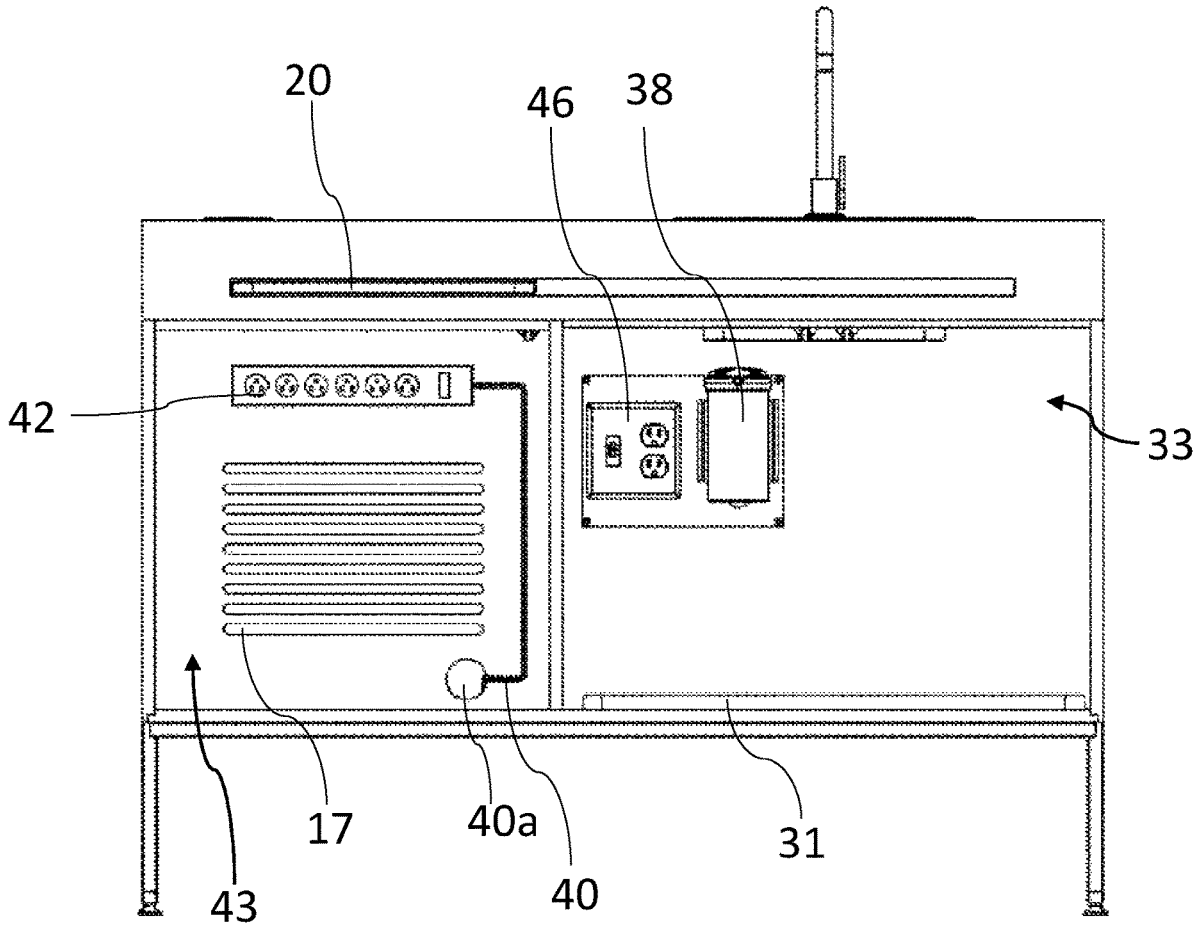
FIG. 18 shows a front view of an exemplary embodiment of the lactation station of the present disclosure in a first deployed configuration with doors and selected internal items removed.

FIG. 18 shows a front view of the lactation station with the doors, refrigerator, freshwater tank, wastewater tank, plumbing, and door-mounted cabinet or wire rack removed for clarity. A rubber drip tray may optionally be included, such as below the freshwater tank, the wastewater tank, or both. Other materials, structures, or components may also optionally be used to retain any water or other fluids which may potentially drop or leak. Water heaters may optionally be used or mounted to heat water for the faucet.

The back of the lactation station may include one or more openings for routing electricity supply into the lactation station, such as the opening 40*a* for a power cord 40 shown in this embodiment. The back of the lactation station may also optionally include one or more vent openings 17 to aid in cooling of air which has been heated by a refrigerator or other refrigeration unit. As shown, the refrigerator cabinet includes a plurality of vent slots. Heat generated at the back of a refrigerator may vent through these slots, reducing the likelihood of the refrigerator overheating or having other failures. In some embodiments, an auxiliary fan may be installed to exhaust air from a compartment 43 through a vent 17 to the exterior of the primary body unit 11.

Figure 19:
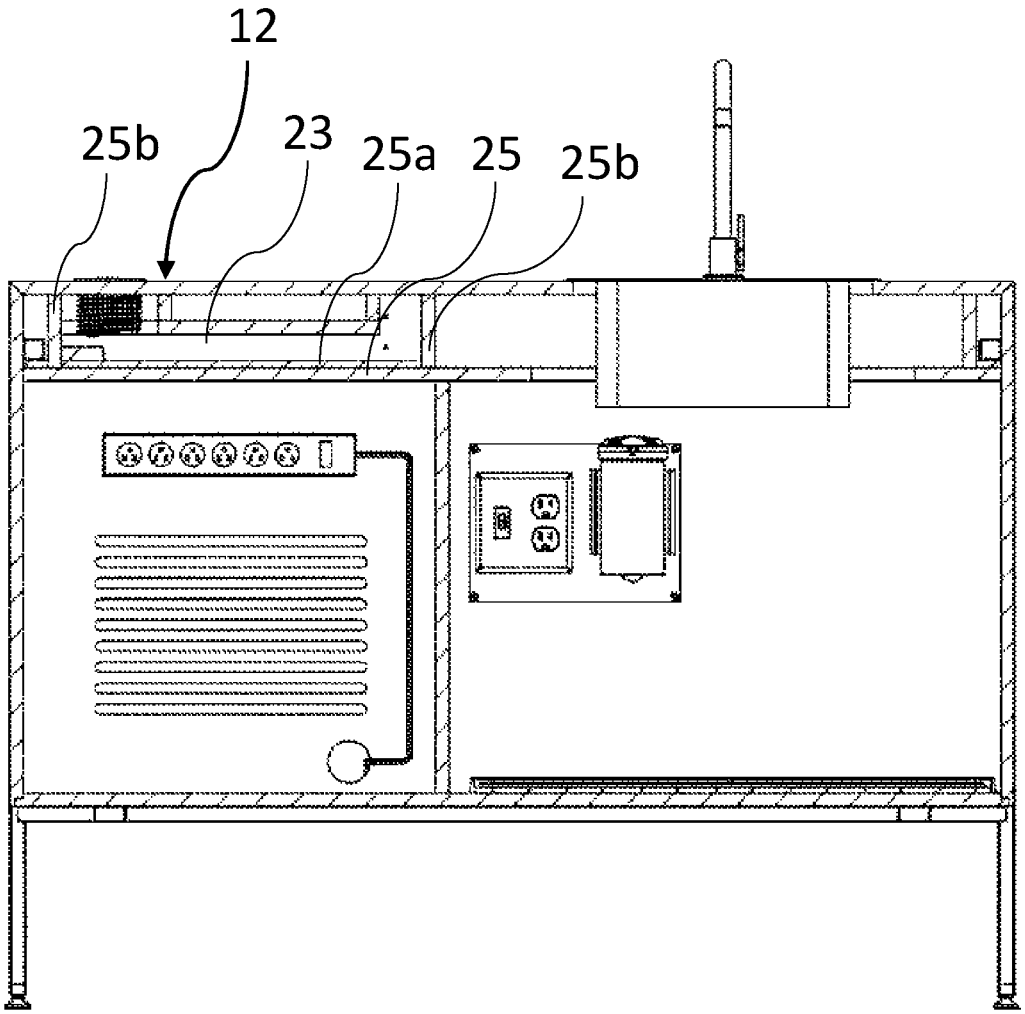
FIG. 19 shows a front cross-sectional view of an exemplary embodiment of the lactation station of FIG. 18 with selected items removed.
Figure 20:
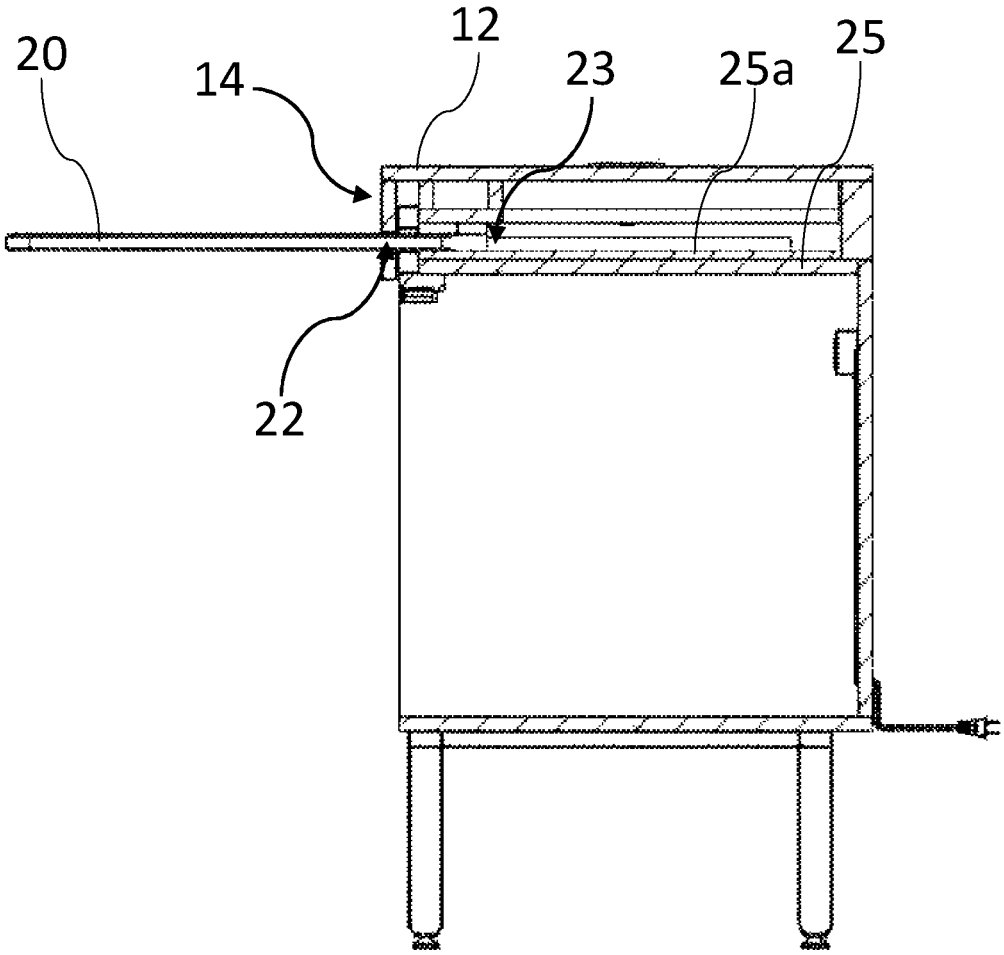
FIG. 20 shows a right side cross-sectional view of an exemplary embodiment of the lactation station of FIG. 18 with doors and selected items removed.

FIGS. 19 and 20 show cross-sectional front and side views, respectively, of the lactation station. Support structures, including a steel frame, may be included underneath the counter to provide greater rigidity to the counter as well as partitioning off different internal areas within the upper portion of the lactation station, such as to restrict movement of the adjustable counter, to separate electrical components from potentially wet areas, or to prevent potential cross-contamination between different areas of the lactation station.

Figure 22:
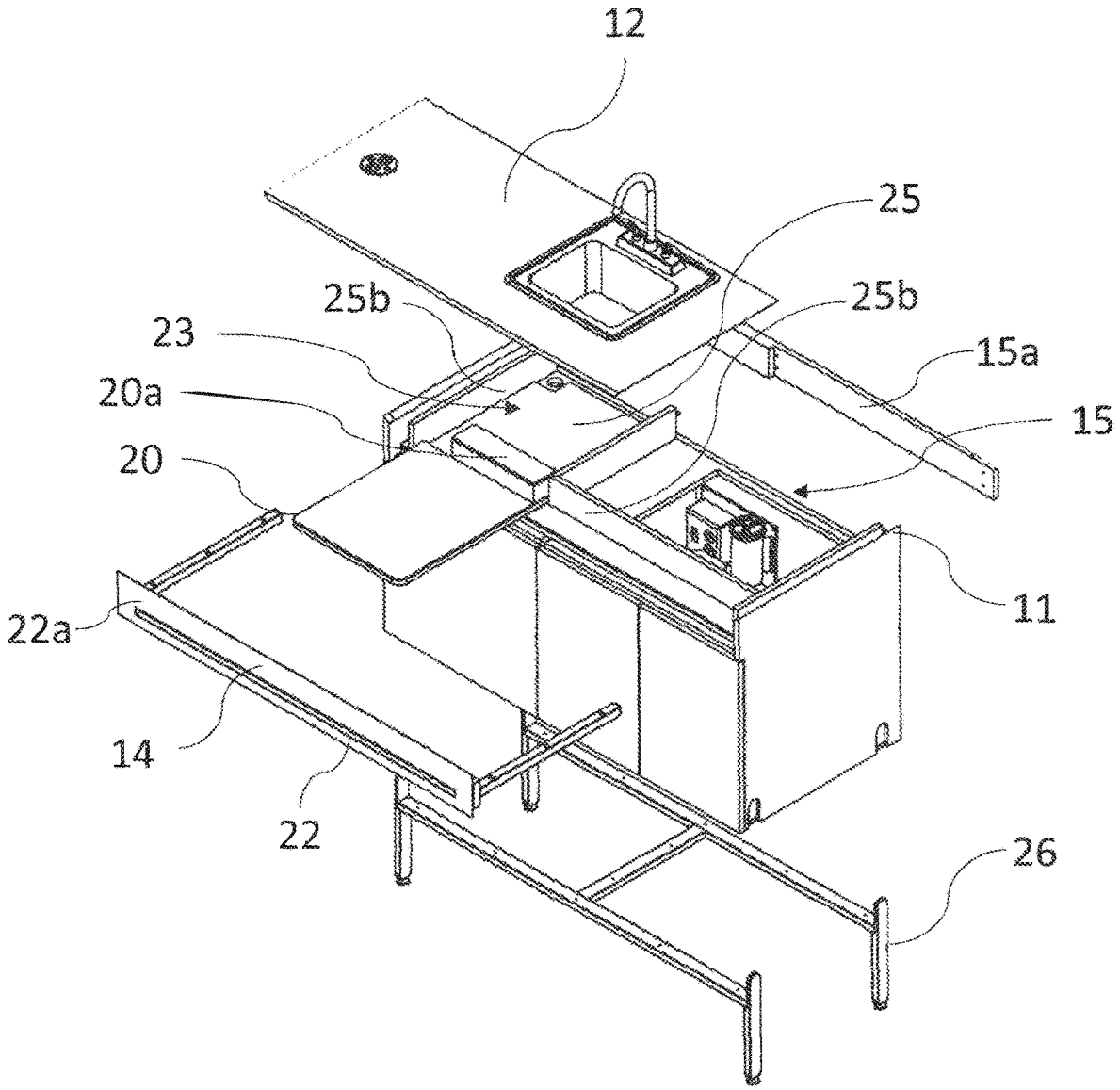
FIG. 22 shows an exploded perspective view of an exemplary embodiment.

An exemplary embodiment is depicted in FIG. 22 as an exploded perspective view. In some embodiments, the base unit 11 may comprise one or more optional rear panels 15*a* in addition to one or more rear faces 15. In some embodiments, a countertop or top surface 12 may define a recessed compartment 23 that opens to the front face 14 of the unit through the recess 22. In some embodiments, the recessed compartment 23 may be generally defined by the top surface 12 and a middle panel 25. In some embodiments, an additional panel or sheet, such as a laminate sheet 25*a* or a filler sheet, may rest upon, be adhered to, be fastened to, or be otherwise associated with a middle panel 25*a* within a recessed compartment 23. In some embodiments, a laminate sheet may be included to alter the friction between the adjustable counter component and the base unit or primary body unit. In some embodiments, a laminate sheet may be incorporated on the adjustable counter component to alter the friction between the adjustable counter component and the base unit or primary body unit. In some embodiments, a laminate or filler sheet 25*a* may function to allow the adjustable counter component to easily slide upon it to be deployed, closed, or moved between different configurations. In some embodiments, dividers 25*b* extending vertically from the middle panel 25 may be incorporated as guides or limits for the adjustable counter component 20. Within the recessed compartment 23 the adjustable counter component may have a block 20*a* that is connected to a portion of the adjustable counter component by any appropriate means. In some embodiments, the adjustable counter component 20 and block 20*a* are a single piece that is milled, molded, 3D printed, or produced in any appropriate manner from any appropriate materials.

The thickness of a block 20*a* and adjustable counter component 20 may have a height partly or substantially comparable to the height of the recessed compartment 23 defined by the shortest distance between the top portion 12 and the middle panel 25, optionally including the thickness of a laminate sheet 25*a* if included. In some embodiments, the recess may be disposed within a separate recess panel 22*a* that is a portion of the front face 14. In some embodiments, the recess may not be disposed within a separate recess panel. The height of the recess 22 may be, in some embodiments, smaller than the thickness of the adjustable counter component 20 and block 20*a* so that the adjustable counter component cannot be pulled completely through the recess. The recess 22, in some embodiments, may act as a stop for the degree of deployment of the adjustable counter component or may prevent the adjustable counter component from being removed from the unit. The exemplary embodiment shown in FIG. 22 is only illustrative and the configuration of the adjustable counter component and the recessed compartment 23 can be configured to accommodate or comprise any sliding, rotating, or otherwise deployable and/or movable adjustable counter components.

As shown, the adjustable counter may be at least partially retained by retention features when in one or more open configurations. The retention features may resist the adjustable counter from tilting when in an open configuration or sliding out too far. The retention features may contact only small areas or features of the adjustable tray, sufficiently to resist unwanted motion or rotation, or may contact a substantial width of the adjustable tray, as shown.

Figure 23:
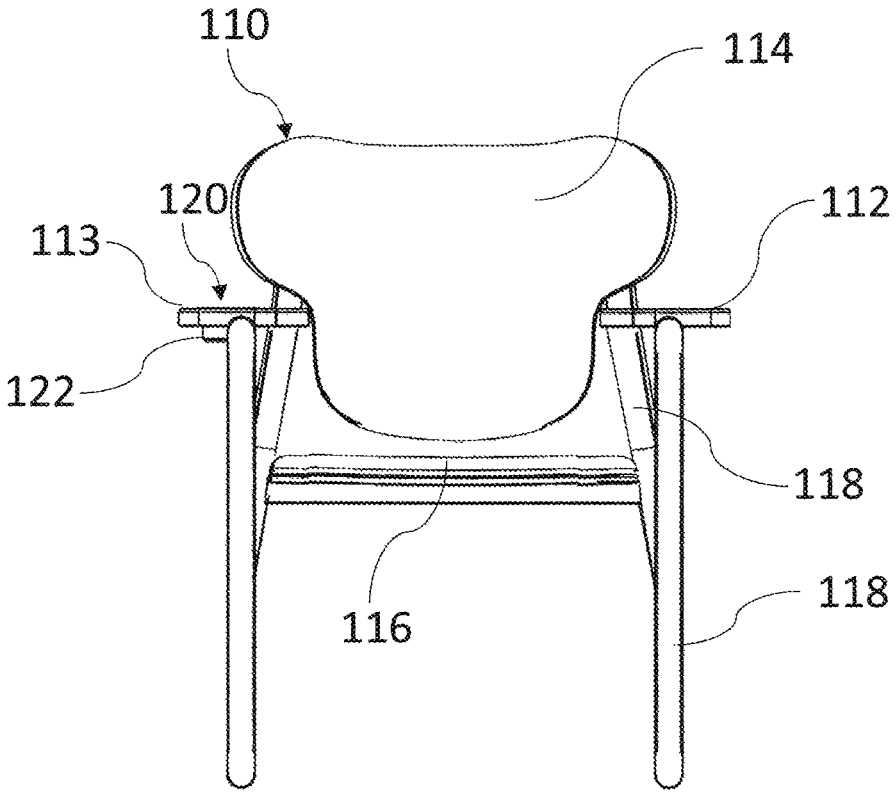
FIG. 23 shows a front view of an exemplary chair embodiment.
Figure 24:
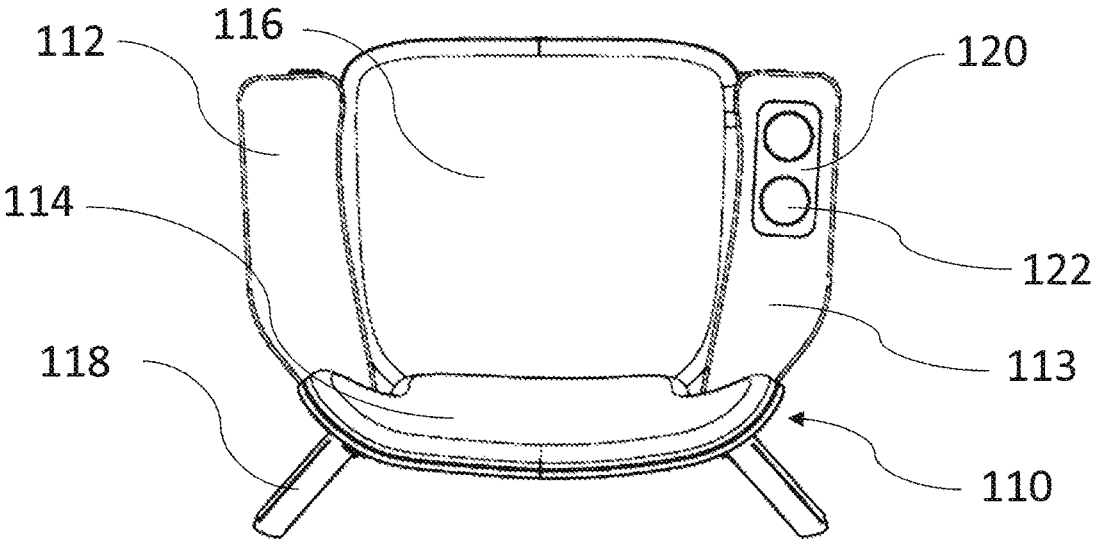
FIG. 24 shows a top view of an exemplary chair embodiment.
Figure 25:
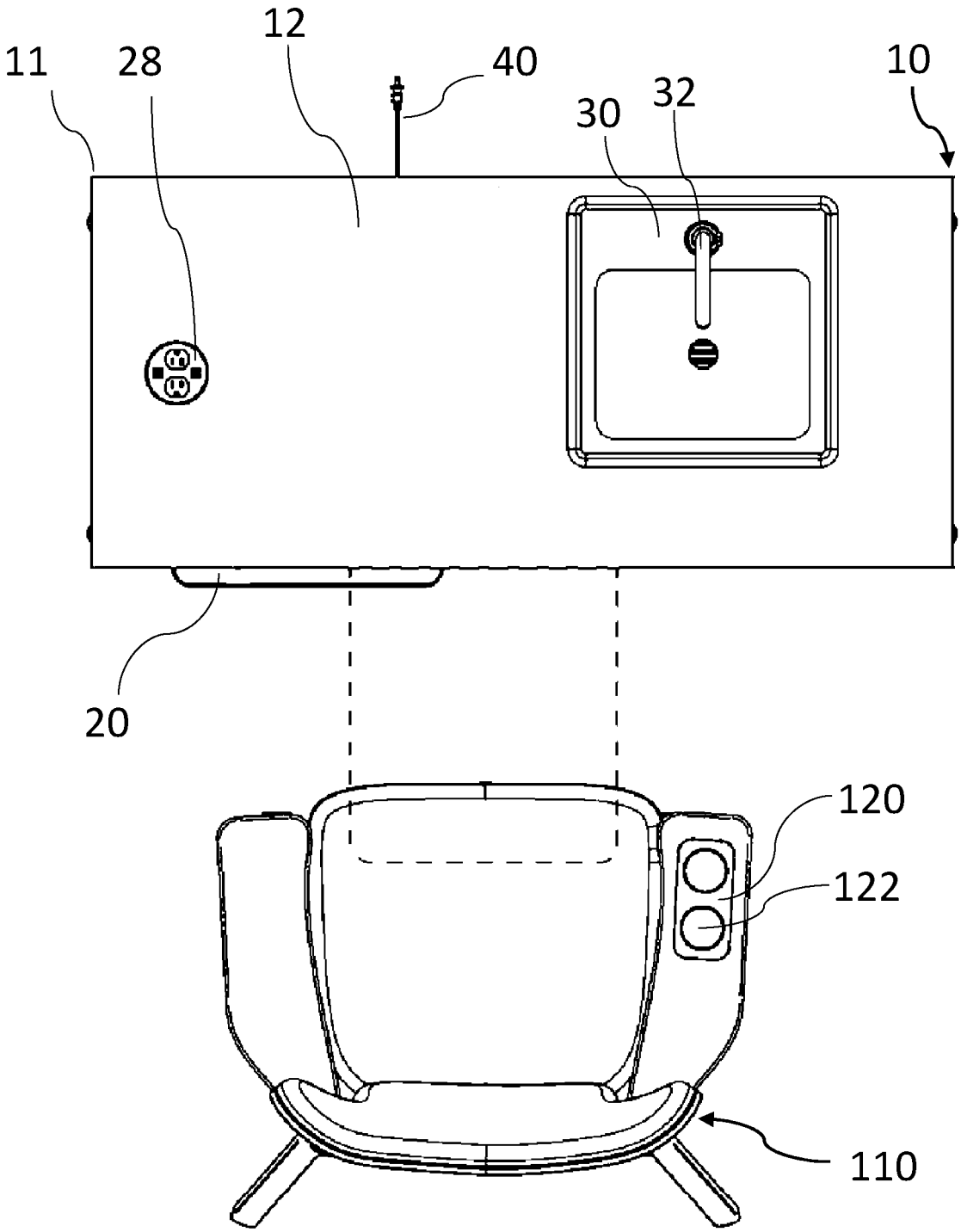
FIG. 25 shows a top view of a closed configuration of an exemplary embodiment of a lactation station with an exemplary chair embodiment arranged in a position for use with the broken line indicating a potential deployed configuration for the lactation station while in use.

In some embodiments, a chair is described for use alone or in conjunction with a lactation station 10 or a primary body unit 11. Some exemplary embodiments of chairs are shown in FIGS. 23-25. A chair 110 may have one or more recesses or cup holder-like features or components to aid in retaining milk bottles. In some embodiments, recesses, or cup holder-like features 122, may be incorporated into an insert member 120 installed into an appropriately dimensioned cutout in a chair arm 113. In some embodiments, a chair may comprise one or more arms with one or more cup holder-like features. In further embodiments, a chair may comprise one arm 112 without recesses or cup holder-like features. A chair may further comprise a back member 114 and a seat member 116. A chair may also comprise three or more legs 118. In some embodiments, the legs may comprise feet or casters.

FIG. 25 depicts an exemplary embodiment of a chair in use with a lactation station. In some embodiments, the chair may be positioned prior to use of the lactation station. In some embodiments, the electrical wire 40 is connected to or plugged into an external power source, such as an outlet. In such embodiments, the user may position the chair at any appropriate position in order to reach the adjustable counter component 20 in any of its possible deployed positions along the primary body unit 11. In some embodiments, the user may pull out the adjustable counter component once seated and place any pumping devices, such as a breast pump, on the adjustable counter component as well as any working materials, such as, e.g., laptops, cellular phones, papers, tablets, or books. In further embodiments, the user may place any pumping devices or work materials on the adjustable counter component while it is moved into a position where the user may access the chair to sit. After sitting, the adjustable counter component with a breast pump and any working materials seated on top of it may be repositioned to be in reach of the user. In the exemplary embodiment in FIG. 25, the deployed adjustable counter component 20 is shown by a broken line in a middle-deployed position. In some embodiments, the chair may be positioned or rotated in any appropriate position for the user to reach the deployed or partly deployed adjustable counter component.

The breast pumping device may be connected to a milk bottle which may be placed in the recesses or cup holder-like features of the chair. In some embodiments, the recesses or cup-holder-like features are adapted to hold a milk bottle connected to a breast pump. While the breast pump is in use, the user may use work materials positioned on the adjustable counter component. If necessary, the adjustable counter component may be further positioned while in use. Once the user is finished pumping, the adjustable counter component may be repositioned to allow the user to exit the chair. It can be appreciated that the adjustable counter component may take various shapes and sizes depending upon the specific application and equipment utilized with it. In some embodiments, the adjustable counter component may further comprise a removable or permanent surface covering to prevent pumps or work materials from slipping or moving. In some embodiments, a USB or power source may be incorporated into the adjustable counter component.

In some embodiments, the lactation station and adjustable counter component are adapted for accessibility by users with injuries or handicaps. In certain embodiments, the lactation station may be adapted for use with a wheelchair or electric chair. In some embodiments, the USB and electrical outlet 28 may be repositioned closer to the front edge of the top surface or may be relocated to the front face in order to be accessible for a user that must remain seated. In further embodiments, the sink may be repositioned or lowered optionally with a lowered top surface in order to be accessible for a user that must remain seated. In some embodiments, a faucet may be repositioned and/or have a valve that is repositioned or adapted for use by a user that must remain seated.

While the present disclosure has been related in terms of the foregoing embodiments, those skilled in the art will recognize that the invention is not limited to the embodiments described. The present disclosure can be practiced with modification and alteration within the spirit and scope of the appended claims. Thus, the description is to be regarded as illustrative instead of restrictive on the present disclosure. Accordingly, various modifications, adaptations, combinations, and alternatives may occur to one skilled in the art without departing from the spirit of the disclosure and scope of the claimed coverage.

What is claimed is:

1. A portable apparatus, comprising:

a base unit including:

a top surface, a middle panel spaced apart from the top surface;

a sink disposed within the top surface, a first side face, a second side face, and a rear face extending downwardly from the top surface, one or more dividers extending between the top surface and the middle panel, thereby defining an internal compartment, and at least one front surface defining a recess formed within the at least one front surface, a first end of the recess being proximal to the first side face and a second end of the recess being distal to the first side face, wherein a first divider of the one or more dividers is positioned between a first edge of the sink and a first side face of the one or more side faces, and a second divider of the one or more dividers is positioned between a second edge of the sink and the at least one front surface, the second divider being substantially perpendicular to the first divider; and at least one adjustable counter component disposed at least partially within the recess, the at least one adjustable counter component comprising a projection and being slidable within the internal compartment relative to the sink wherein the at least one adjustable counter component can be slidably moved in a first direction such that the projection moves along the first divider to a first deployed position, the first direction being defined from the rear face to the at least one front surface, and wherein, from the first deployed position, the at least one adjustable counter component can be slidably moved in a second direction such that the projection moves along the second divider to at least a second deployed position, the second direction being defined by the recess.

2. The portable apparatus of claim 1, wherein the recess extends a length of the at least one front surface parallel to a surface on which the base unit is placed, wherein the recess is located at a center of the at least one front surface and proximal to the top surface.

3. The portable apparatus of claim 2, wherein the at least one adjustable counter component is partially housed within the recess; and wherein the at least one adjustable counter component extends through the recess within the at least one front surface when the at least one adjustable counter component is in either a closed position or the deployed position.

4. The portable apparatus of claim 3, wherein the at least one adjustable counter component is slidably connected to the base unit.

5. The portable apparatus of claim 4, further comprising a laminate or a layer to alter friction between the at least one adjustable counter component and the base unit.

6. The portable apparatus of claim 1, wherein the top surface is substantially planar and parallel to a surface on which the base unit is placed.

7. The portable apparatus of claim 6, wherein the at least one adjustable counter component is substantially parallel to the top surface.

8. The portable apparatus of claim 7, wherein the at least one adjustable counter component is substantially parallel to the top surface when the at least one adjustable counter component is in a closed position.

9. The portable apparatus of claim 7, wherein the at least one adjustable counter component is substantially parallel to the top surface when the at least one adjustable counter component is in either the first deployed position or the second deployed position.

10. The portable apparatus of claim 1, wherein the base unit further comprises a sink and faucet.

11. The portable apparatus of claim 10, further comprising a freshwater supply unit to the faucet.

12. The portable apparatus of claim 11, further comprising one or more electrical supply outlets connected to an external power source.

13. The portable apparatus of claim 12, wherein the freshwater supply unit comprises:

a water container;

an inlet tube having a first end and a second end opposed to the first end;

an electric water pump; and an outlet tube having opposed first and second ends;

wherein the first end of the inlet tube is capable of being inserted into the water container such that it is below a water level in the water container;

wherein the electric water pump is connected to the second end of the inlet tube and the first end of the outlet tube; and wherein second end of the outlet tube is connected to the faucet.

14. The portable apparatus of claim 13, wherein the outlet tube further comprises one or more in-line electric water heaters connected between the first and second ends.

15. The portable apparatus of claim 13, wherein the outlet tube further comprises a tee, wherein the tee is connected to a heated water outlet tube that is connected to the faucet, and wherein the heated water outlet tube has one or more in-line water heaters.

16. The portable apparatus of claim 10, further comprising a drain container fluidly connected to the sink by a drain tube.

17. The portable apparatus of claim 12, further comprising a permanent or removable refrigeration unit.

18. The portable apparatus of claim 12, further comprising an electrical and USB outlet disposed on the top surface.

19. A portable lactation station, comprising:

a base unit; and at least one adjustable counter component;

wherein the base unit comprises:

a countertop, a front face, a first side face, a second side face, and a rear face extending downwardly from the top surface, one or more dividers extending from the countertop, thereby defining an internal compartment;

a sink disposed within the countertop, and a recess in the base unit having a first end distal to the sink and a second end proximal to the sink, wherein a first divider of the one or more dividers is positioned between a first edge of the sink and a first side face of the one or more side faces, and a second divider of the one or more dividers is positioned between a second edge of the sink and the at least one front surface, the second divider being substantially perpendicular to the first divider;

wherein the at least one adjustable counter component is at least partially recessed within the recess in the base unit with a remainder of the at least one adjustable counter component protruding outwardly from the base unit;

wherein the at least one adjustable counter component is slidable within the internal compartment relative to the sink;

wherein the at least one adjustable counter component has a closed position that minimizes an outward protrusion of the at least one adjustable counter component from the recess, and at least two deployed positions that maximize the outward protrusion of the at least one adjustable counter component from the recess;

wherein the at least one adjustable counter component can be slidably moved in a first direction along the first divider to a first deployed position of the at least two deployed positions, the first direction being defined from the rear face to the at least one front surface, and wherein, from the first deployed position, the at least one adjustable counter component can be slidably moved in a second direction along the second divider to at least a second deployed position of the at least two deployed positions, the second direction being defined by the recess in the base unit, wherein the at least one adjustable counter component is lockable in one or more of the deployed positions.

20. The portable lactation station of claim 19, wherein a closed position is located at the first end, the first deployed position is located at the first end, the second deployed position is located at the second end, a third deployed position is located at a midpoint between the first end and the second end, and a plurality of further deployed positions are located at any position between the first end and the second end.

* * * * *